US006416919B1

(12) United States Patent
Yanagida et al.

(10) Patent No.: US 6,416,919 B1
(45) Date of Patent: Jul. 9, 2002

(54) CARRIER, DEVELOPER, AND IMAGE-FORMING METHOD

(75) Inventors: Kazuhiko Yanagida; Suk Kim, both of Minami-Ashigara; Shigeru Inaba, Ashigarakami-gun; Taku Fukuhara, Ashigarakami-gun; Yasuhiro Oda, Ashigarakami-gun, all of (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/676,817

(22) Filed: Oct. 2, 2000

Related U.S. Application Data

(62) Division of application No. 08/887,331, filed on Jul. 2, 1997.

(30) Foreign Application Priority Data

| | | |
|---|---|---|
| Jul. 4, 1996 | (JP) | 8-175259 |
| Jul. 5, 1996 | (JP) | 8-176881 |
| Oct. 17, 1996 | (JP) | 8-274769 |
| Nov. 29, 1996 | (JP) | 8-320444 |

(51) Int. Cl.[7] ..... G03G 13/09
(52) U.S. Cl. ..... 430/122; 430/120; 430/111.41
(58) Field of Search ..... 430/122, 120, 430/106.6, 108, 111.41, 103; 399/55, 56

(56) References Cited

U.S. PATENT DOCUMENTS

| | | | | | |
|---|---|---|---|---|---|
| 3,898,170 | A | * | 8/1975 | Kasper | 252/62.1 L |
| 4,601,967 | A | * | 7/1986 | Suzuki et al. | 430/106.6 |
| 5,346,791 | A | * | 9/1994 | Ozawa et al. | 430/106.6 |
| 5,391,451 | A | * | 2/1995 | Yoshie et al. | 430/106.6 |
| 5,733,699 | A | * | 3/1998 | Asanae et al. | 430/108 |
| 5,822,650 | A | * | 10/1998 | Noda et al. | 399/55 |

FOREIGN PATENT DOCUMENTS

| | | | | |
|---|---|---|---|---|
| JP | 52-154640 | * | 12/1977 | |
| JP | A-52-154640 | | 12/1977 | |
| JP | A-61-107257 | | 5/1986 | |
| JP | 61-107257 | * | 5/1986 | |
| JP | 61-130959 | * | 6/1986 | |
| JP | A-61-130959 | | 6/1986 | |
| JP | 3-72372 | * | 3/1991 | 430/108 |
| JP | A-6-161157 | | 6/1994 | |
| JP | 6-161157 | * | 6/1994 | |
| JP | 7-120086 B | * | 12/1995 | |
| JP | 9-171287 | * | 6/1997 | |

OTHER PUBLICATIONS

Diamond, Arthur S. (editor) Handbook of Imaging Materails. New York: Marcel–Dekker, Inc. pp. 222–223. (1991).*

* cited by examiner

*Primary Examiner*—Christopher Rodee
(74) *Attorney, Agent, or Firm*—Oliff & Berridge, PLC

(57) ABSTRACT

The present invention discloses a carrier, which comprises a core and a resin coating layer formed thereon containing electroconductive powder, wherein, when the magnetic brush is formed only of the core, the dynamic electrical resistance of the core forming the magnetic brush under an electric field of $10^4$ V/cm is 1 Ω·cm or less and the electrical resistance of the resin coating layer is from 10 to $1\times10^8$ Ω·cm, a developer using the carrier, and an image-forming method using the developer. Owing to the present invention, a superior solid image, which is free of brush marks and carrier beads carry over, can be obtained.

8 Claims, 15 Drawing Sheets

CARRIER, DEVELOPER, AND IMAGE-FORMING METHOD

This is a Division of application Ser. No. 08/887,331 filed Jul. 2, 1997. The entire disclosure of the prior application is hereby incorporated by reference herein in its entirety.

BACKGROUND OF THE INVENTION

1. Field of the Invention

The present invention relates to a carrier used for developing a latent image created in electrostatic photography and electrostatic recording, a developer using this carrier, an image-forming method using this developer, and an image-forming method used in an image-forming apparatus such as a digital printer or a digital copier which processes images as digital signals.

2. Description of the Related Art

In a digital-image-forming apparatus based on letters or image data, on/off binary information is provided as two-dimensional information at a predetermined site on a photoreceptor. When a halftone image is recorded by the above-mentioned system, an area modulation method, which uses a mesh or line screen structure, was conventionally adopted in many printers and copiers based on digital photography because of the relative easy algorithm and low cost involved.

Meanwhile, a method in which image information is visualized via a latent image, e.g., electrostatic photography, is now widely used. Electrostatic photography comprises the steps of forming a latent image on a photoreceptor by electrostatic charging and exposure, developing the latent image using a developer containing toner, transferring the toner image, and fixing the transferred toner image to form a visible image on an image-receiving medium. There are two types of developer, i.e., a two-component developer composed of toner and carrier and a one-component developer composed of a single magnetic toner. The two-component developer, whose role is allotted to the carrier and toner, has superior control and is therefore widely used.

In the developing process used in an image-forming apparatus for reproducing a multiple gradation via electrostatic photography, the cascade method has been superseded by a magnetic brush method in which a magnetic roller is used as a developer carrying member. Particularly, in the case of a color image-forming apparatus, because of the stabilized charge of the developer, a magnetic brush method using a two-component developer, which comprises a carrier and toner, is more suitably employed.

Two types of magnetic brush method using a two-component developer are known: the conductive magnetic brush development (CMB), which uses a conductive carrier, and the insulated magnetic brush development (IMB), which uses an insulated carrier. In CMB development, because of the carrier's lower resistance level, the electrical charge is injected from a developing roller so that the carrier near the photoreceptor serves as a developing electrode to enhance a practical electric field for development. As a result, since toner is sufficiently transported, a superior solid image free of the edge effect can be reproduced. However, CMB development has the disadvantage that, since the relationship between latent image potential and image density of the photoreceptor changes abruptly as indicated by the steep slope of the curve, image defects such as white lines called brush marks, i.e., latent image destruction due electrical charge injection from the developing roller, and so-called carrier beads carry over, i.e., migration of the carrier to the photoreceptor, tend to occur. On the other hand, in IMB development, the relationship between latent image potential and image density of the photoreceptor is linear and has a gentle slope. The disadvantages of IMB development are that solid images are poorly filled and that the edge effect is significant.

If the degree of the above defects is insignificant, black-and-white images, which are formed by black toner alone, are not seriously influenced in sensory inspection. The above defects, however, present a fatal drawback to color images formed by the overlap of multiple toner colors. This is because, in a color image, these defects cause a slight change in color, causing "noise" due to different colors in a gradated range, even though these defects are only a slight change in density in black-and-white images. Accordingly, these defects extremely adversely affect the impression of color images in particular.

Because of this background, conductive magnetic brush methods, which exhibit superior performance in terms of filling of solid image, edge effect, carrier beads carry over and brush marks, have been disclosed.

For example, Japanese Patent Application Publication (JP-B) No. 7-120,086 discloses a method based on the electrical resistance of a carrier, which comprises a core having a relatively low electrical resistance coated with a resin having a high electrical resistance which abruptly changes in an electric field having a specific strength, causing the electrical resistance of the carrier to increase in a weak electric field, whereas the electrical resistance of the carrier decreases in a strong electric field. Based on this disclosure, since a stronger electric field exists in the latent image area and a weak electric field exists in the nonimage area, use of this carrier enables superior solid black image printing without carrier beads carry over to the nonimage area. However, based on the examples and description of the function of the invention in the above Japanese Patent Application Publication (JP-B) No. 7-120,086, the resin coating layer is so thin that a core having a lower electrical resistance is believed to be partly exposed, which leads to lower electrical resistance of the carrier under a strong electric field. To substantiate this assumption, comparative examples, which are described later, verify that the electrical resistance of a carrier, produced by completely coating a core with a thick layer of resin, exhibits a higher electrical resistance even in a strong electric field and does not provide a superior solid image. The partial coated carrier, which has a partly exposed core having lower electrical resistance, tends to cause brush marks in the latent image because the electrical charge moves easily via exposed surfaces.

Japanese Patent Application Laid-Open (JP-A) No. 61-107,257 and Japanese Patent Application Laid-Open (JP-A) No. 61-130,959 disclose a ferrite which has a relatively low electrical resistance and has surface roughness caused by primary particles. According to the disclosure, because of carrier particle roughness, leakage between oppositely polarized charges is inhibited so that brush mark formation is inhibited. The disadvantage, however, is that the presence of the roughness on the carrier surface increases the contact area between the carrier and toner so that toner adheres more to the carrier surface, which diminishes the charge-imparting capability of the carrier over time.

Japanese Patent Application Laid-Open (JP-A) No. 6-161,157 specifies the ratio of the electrical resistance of the core to the electrical resistance of the resin-coated carrier itself so that the carrier provides superior resolution, proper solid image density, and fine line reproduction. No remarked effect is seen, however, in preventing image defects, particularly in color images.

As stated above, none of the available carriers and image-forming methods perform satisfactorily in view of recent stringent requirements for high-quality images, including color images, because existing carriers and image-forming methods do not solve the problems of image defects associated with the conductive magnetic brush, namely, the problems of carrier beads carry over and brush marks caused by the destruction of the latent image due to bias leakage.

SUMMARY OF THE INVENTION

Accordingly, one object of the present invention is to provide a carrier, which produces a superior solid image free of brush marks and carrier beads carry over, particularly in color images, and which is durable for a long time, and to provide a developer using this carrier and, further, to provide an image-forming method using this developer.

Another object of the present invention is to provide an image-forming method which have the advantage of stabilizing the amount of toner moving to a latent image, even if the photoreceptor is not uniformly sensitive, producing halftone images having excellently filled solid images free of edge effects and brush marks and preventing carrier beads carry over.

To solve the above problems, the present inventors have conducted studies and found that, in order to obtain a superior solid image by preventing image defects such as brush marks and carrier beads carryover, the electrical resistance of the carrier must be within a specific range, and that this condition can be attained by using a carrier core having an electrical resistance not exceeding a specific value and a resin coating layer having an electrical resistance falling within a specific range.

Further, to obtain a developer which provides a superior solid image free of the edge effect and of carrier beads carry over and brush marks by adjusting the electrical resistance of the resin-coated carrier, the present inventors found that it is necessary to use a developer having a saturated region in the developing curve defined by a contrast potential, which is determined by bias potential for development and the potential at the exposed part on a latent image substrate, and the amount of developer toner moving to the latent image on the latent image substrate, in order to stabilize the amount of developer toner and that, even if the electrical resistance of the resin-coated carrier itself is the same, the saturation characteristic varies with the electrical resistance of the core. As a result, they achieved an invention based on these findings.

That is, the carrier according to the present invention comprises a core and a resin coating layer containing an electroconductive powder formed on the core, wherein, when the magnetic brush is formed only of the core, the dynamic electrical resistance of the core forming the magnetic brush under an electric field of $10^4$ V/cm is 1 Ω·cm or less and the electrical resistance of the resin coating layer is from 10 to $1\times10^8$ Ω·cm.

The developer according to the present invention comprises the above-described carrier and toner containing a binder resin and a colorant.

The image-forming method according to the present invention comprises the steps of forming a latent image on a latent image substrate, developing the latent image using a developer, transferring the developed toner image to an image-receiving medium, and thermally fixing the toner image on the image-receiving medium, wherein the developer is the above-described developer.

In this image-forming method, developing the latent image can be carried out by means of a developer held on a developer carrying member provided with a bias potential for development, and a developer having a saturated region in the developing curve defined by a contrast potential, which is determined by a bias potential for development and the potential at the exposed part on the latent image substrate, and the amount of developer toner moving to the latent image on the latent image substrate, can be used and the bias potential for development can be applied to the developer carrying member so that the amount of developer toner exhibits the saturation characteristic.

The carrier of the present invention comprises a core having a low level of electrical resistance, which is indicated by a dynamic electrical resistance of 1 Ω·cm or less as measured in a form of a magnetic brush formed only by the core under an electric field of $10^4$ V/cm, and a resin coating layer having an intermediate level of electrical resistance which is from 10 to $1\times10^8$ Ω·cm.

The use of the above structure makes it possible to simultaneously achieve two objectives, i.e., to obtain a superior solid image and to prevent defects such as brush marks and carrier beads carry over. The mechanism is presumably as follows: Generally, if a conductor is placed in an electric field, the electrical charge is reoriented, i.e., polarization occurs. The speed of polarization depends on the resistance of the conductor, i.e., the lower the resistance, the faster the polarization. This phenomenon occurs within the core which is placed between the developing roller and the photoreceptor. If core resistance is so low that the core becomes polarized within about $10^{-3}$ second, which is the time interval for development, a superior solid image can be obtained, because the formation of the developing electrode by the polarization of the core itself in addition to charge injection from the developing roller will act advantageously. However, a superior solid image cannot be obtained if the total electrical resistance of the carrier increases due to the high electrical resistance of the resin coating layer, even if the electrical resistance of the core is low. Meanwhile, since the electrical charge injected from the developing roller flows mainly through the surface of the carrier, brush marks and carrier beads carry over tend to occur, if the electrical resistance of the resin coating layer is too low. In the present invention, since the electrical resistance of the resin coating layer is within a specified range, it is possible to obtain a superior solid image without brush marks or carrier beads carry over occurring.

There is no theoretically established explanation for the fact that a satisfactorily saturated region can be obtained when the electrical resistance of the core is low, even if the electrical resistance of the entire carrier is relatively high. Presumably, the mechanism is as follows: If the electrical resistance of the carrier is high, saturation cannot be easily attained, because the slope at the start of the developing curve is gentle due to a weak electric field for development and this condition causes an electric field within the layer of the developer and sends the toner to the latent image for development both from the surface layer of the developer and from the inside of the developer layer. On the other hand, if the electrical resistance of the carrier is low, the amount of developer toner becomes saturated, because the slope at the start of the development curve is so steep due to a strong electric field for development that the inside of the developer layer is almost electroconductive and therefore has no electric field and because only the toner, which is present on the developer layer, is used for development. In other words, if the electrical resistance of the core is low, the developing electrode is formed near the latent image substrate, which produces the saturated region.

Further, since low electrical resistance of the core effectively polarizes the core itself, the saturated region is understood to be obtainable, even if the electrical resistance of the carrier is high, as opposed to when the electrical resistance of the core is high.

DESCRIPTION OF THE PREFERRED EMBODIMENTS

Figure 1:
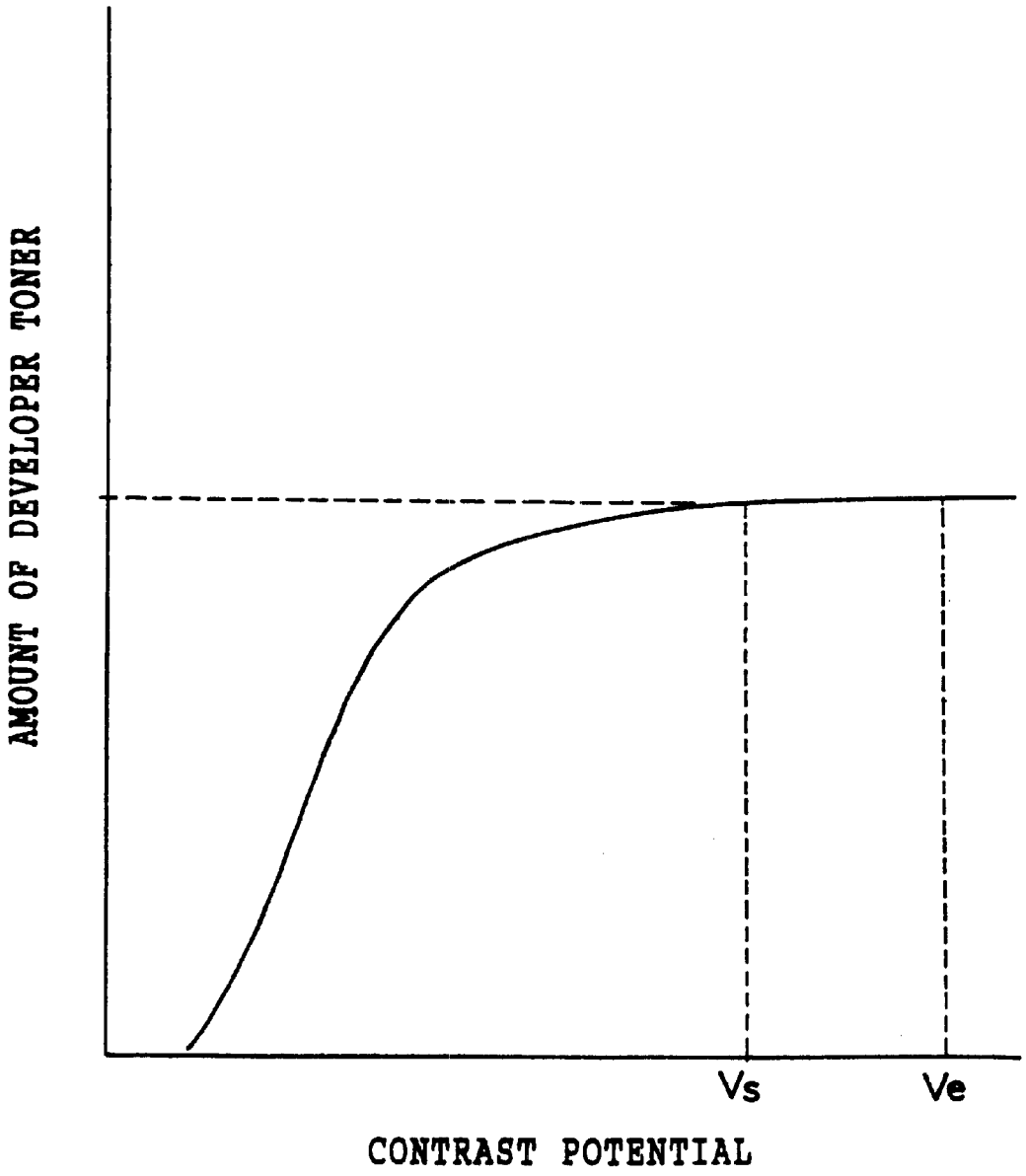
FIG. 1 shows a developing curve defined by the contrast potential and amount of developer toner wherein the curve has a saturated region.

In the present invention, although known iron powder, ferrite, magnetite or the like may be used appropriately as a carrier core, a low-resistance ferrite is particularly preferable. Iron powder has a large specific gravity, and toner or additive easily adheres to iron powder. Therefore, iron powder is inferior to ferrite in stability, while magnetite has the problems of narrow latitude of resistance and difficulty in controlling resistance. The advantage of ferrite is that resistance can be lowered, for example, by reducing of the ferrite after firing in a hydrogen stream at a certain temperature, wherein ferrite having different values of resistance can be obtained by varying conditions such as the amount of hydrogen, temperature, and the time for reduction.

When a magnetic brush is formed only of the carrier core to be used in the present invention, the dynamic electrical resistance of the carrier core forming the brush must be 1 Ω·cm or less, under an electric field of $10^4$ V/cm, which is close to that of an actual machine. If resistance exceeds 1 Ω·cm, the problem is that a carrier having resistance lower than a desired value cannot be obtained or the saturated region cannot be obtained unless the resistance of the resin coating layer is significantly reduced and that, if the resistance of the resin coating layer is lowered too much, image defects, such as brush mark formation due to bias leakage and carrier beads carry over, occur. If the core is made from iron powder, the core resistance can be adjusted, for example, by the amount of trace elements or the degree of surface oxidation. On the other hand, if the core is made from ferrite, the core resistance can be adjusted, for example, by the mixing ratio of metal oxides or by heat treatment after granulation. Since manufacturers of magnetic materials have commercialized cores having a variety of values of electrical resistance through the use of different raw materials or manufacturing conditions as described above, such commercialized cores can be used in the present invention.

The average particle diameter of the carrier core is from 10 to 100 μm, preferably 20 to 80 μm. If the average particle diameter of the carrier core is less than 10 μm, the developer tends to scatter from the developing device, whereas if the average particle diameter exceeds 100 μm, it is difficult to obtain an image having a sufficient density.

Examples of the resin, which constitutes the resin coating layer, are polyolefinic resins, such as polyethylene and polypropylene; polyvinyl resins and polyvinylidene resins, such as polystyrene, acrylic resin, acrylate resin, methacrylate resin, polyacrylonitrile, polyvinyl acetate, polyvinyl alcohol, polyvinyl butyral, polyvinyl chloride, polyvinyl carbazole, polyvinyl ether and polyvinyl ketone; vinylchloride/vinylacetate copolymers; styrene/acrylic acid copolymers, styrene/acrylate copolymers, styrene/methacrylate compolyment; straight silicone resins comprising organosiloxane linkages or modified products thereof; fluorine-containing resins, such as polytetrafluoroethylene, polyvinyl fluoride, polyvinylidene fluoride, and polychlorotrifluoroethylene; polyester; polyurethane; polycarbonate; amino resins, such as a urea/formaldehyde resin; and epoxy resins. These resins may be used alone or in a combination of two or more.

The resin coating layer is from 0.1 to 5 $\mu$m thick, preferably 0.3 to 5 $\mu$m thick, and more preferably 0.5 to 3 $\mu$m thick. If the resin coating layer is less than 0.1 $\mu$m thick, an insulating resin may be used as the coating layer. However, if an electroconductive resin is used as the coating layer, the coating layer is preferably 0.3 $\mu$m or thicker. If the resin coating layer is less than 0.1 $\mu$m thick, it is difficult to form a uniform resin coating layer on the core surface and therefore an image defect is likely to occur due to the transfer of the electrical charge via the exposed surface if a core having a lower resistance is used as in the case of the present invention, whereas if the resin coating layer is more than 5 $\mu$m thick, it is difficult to obtain a uniform carrier due to the formation of aggregations of carrier particles.

The electrical resistance of the resin coating layer is preferably from 10 to $1\times10^8$ Ω·cm, more preferably $10^3$ to $10^7$ Ω·cm. If the electrical resistance of the resin coating layer exceeds $1\times10^8$ Ω·cm, even if the electrical resistance of the core is low, a superior solid image cannot be obtained, because the electrical resistance of the entire carrier becomes higher, whereas if the electrical resistance of the resin coating layer is less than 10 Ω·cm, brush marks or carrier beads carry over tends to occur, because the movement of the electrical charge is facilitated on the surface of or within the carrier.

The electrical resistance of the resin coating layer can be measured by a procedure comprising forming a resin layer several $\mu$m thick on an electroconductive ITO glass base by an applicator, depositing a gold electrode on the resin layer, obtaining current/voltage characteristics of the gold electrode/resin layer/ITO glass sample under an electric field of $10^2$ V/cm and thereafter calculating the electrical resistance of the resin coating layer.

In order to bring the electrical resistance of the resin coating layer into the above range, the resin coating layer may be admixed with an electroconductive powder, whose electrical resistance is preferably $1\times10^6$ Ω·cm or less. Examples of the powder include carbon black, zincoxide, titanium oxide, tin oxide, iron oxide, and titanium black. An electroconductive powder which has electrical resistance from $1\times10^3$ to $1\times10^6$ Ω·cm is particularly preferable. The use of an electroconductive powder having electrical resistance in the above range makes it possible to broaden the width of the latitude of the development bias. The average particle diameter of the electroconductive powder is from 10 to 500 nm. If the average particle diameter is less than 10 nm, the dispersion of the electroconductive powder in the resin layer is difficult due to the aggregation of electroconductive powder, whereas if the average particle diameter exceeds 500 nm, it is difficult to incorporate the electroconductive powder into the resin coating layer and to control the electrical resistance of the resin coating layer to within the specific range. The electroconductive powder content of the resin coating layer is generally from 3% to 50% by volume of the resin coating layer, preferably 4% to 50% by volume of the resin coating layer, and more preferably 5% to 40% by volume of the resin coating layer. If the electroconductive powder content is less than 3% by volume, the electrical resistance of the resin coating layer is not reduced to the desired value, whereas if the electroconductive powder content exceeds 50% by volume, the resin coating layer becomes brittle and the core becomes exposed during use, thus leading to image defects because of the movement of the electrical charge.

Meanwhile, the electroconductive powder content is preferably from 20% to 40% by volume if the water-repellent property of the coating resin indicated by the contact angle of the resin to water is 90° or greater or the coating resin has low surface energy. If such resin is used as a coating layer, since part of the electroconductive powder is exposed to form projections so that the surface area is increased, the resin coating layer becomes more water-repellent or surface energy is further lowered. As a result, the durability of the coating layer is enhanced, because the impact of toner or of additives adherent to the toner, such as silica, titania, and alumina, on the resin coating layer is prevented.

On the other hand, if the coating resin is hydrophilic and has a contact angle of the resin to water of less than 90° or the coating resin has high surface energy, a higher content of the electroconductive powder brings about undesirable results; for example, the resin coating layer becomes excessively hydrophilic due to the increased surface area or surface energy becomes excessively high. The contact angle of the resin to water can be measured by a procedure comprising forming a resin layer of several $\mu$m thick on a sheet of glass base by an applicator and thereafter conducting measurement using an ordinary apparatus for measuring the contact angle.

Examples of the method for forming a resin coating layer on the core include an immersion method wherein a core powder is immersed in a coating-layer-forming solution comprising a resin solution and an electroconductive powder dispersed therein, a spray method wherein a coating-layer-forming solution is sprayed on the surface of a core powder, a fluidized bed method wherein a coating-layer-forming solution is sprayed on a core powder which is floated by means of fluidizing air, and a kneader coater method wherein a core powder and a coating-layer-forming solution are blended in a kneader and thereafter the solvent is removed.

A solvent to be used in a coating-layer-forming solution is not particularly limited so long as the solvent dissolves the resin. Examples of the solvent are aromatic hydrocarbons such as toluene and xylene, ketones such as acetone and methyl ethyl ketone, and ethers such as tetrahydrofuran and dioxane. A sand mill, homomixer, or the like can be used for dispersing the electroconductive powder.

When a magnetic brush is formed only of the carrier produced in the above-described way, the resistance of the carrier forming the magnetic brush is usually from 10 to $1\times10^9$ Ω·cm, preferably $10^3$ to $1\times10^9$ Ω·cm, as measured under an electric field of $10^4$ V/cm. If the electrical resistance of the carrier is less than 10 Ω·cm, the carrier tends to adhere to the latent image substrate and brush mark tends to be formed, whereas if the electrical resistance of the carrier exceeds $1\times10^9$ Ω·cm, it is difficult to obtain a superior solid image.

The procedure for the measurement of the electrical resistance of the core or magnetic carrier comprises filling the gap between a plate electrode positioned near a developer carrying member and the developer carrying member with the core or carrier to form a magnetic brush, applying the above-mentioned voltage to measure the current, and thereafter calculating the electrical resistance from the relationship of log J √E, where E is the applied voltage and J is the current density. If the electrical resistance of the magnetic carrier or the core (core in particular) is too low to measure in a strong electric field of $10^3$ V/cm or greater, the value of electrical resistance obtained under an actually employed electric field can be converted to a value in an electric field of $10^4$ V/cm by use of the foregoing equation.

The volume average particle diameter of the magnetic carrier is preferably from 10 to 100 μm, more preferably 20 to 80 μm. If the volume average particle diameter of the carrier is less than 10 μm, the developer tends to scatter from the developing device, whereas if the volume average particle diameter exceeds 100 μm, it is difficult to obtain an image having sufficient density.

In the present invention, the developer is composed of the above-described carrier and toner particles comprising the a binder resin and a colorant. Examples of the binder resin, which is used in toner particles, include homopolymers or copolymers, which are made up of styrenes such as styrene and chlorostyrene, monoolefins such as ethylene, propylene, butylene and isoprene, vinyl esters such as vinyl acetate, vinyl propionate and vinyl benzoate, esters of an a-methylene aliphatic monocarboxylic acids such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate, vinyl ethers such as vinyl methyl ether, vinyl ethyl ether and vinyl butyl ether, and vinyl ketones such as vinyl methyl ketone, vinyl hexyl ketone and vinyl isopropenyl ketone, and polyesters, polyurethanes, epoxy resins, silicone resins, polyamides, modified rosins, paraffin, and wax. Typical examples of the binder resin are polystyrenes, styrene/acrylate copolymers, styrene/methacrylate copolymers, styrene/acrylonitrile copolymers, styrene/butadiene copolymers, styrene/maleic anhydride copolymers, polyethylene, and polypropylene.

Typical examples of the colorant include carbon black, nigrosin dye, aniline blue, chalcoyl blue, chromium yellow, ultramarine blue, DuPont oil red, quinoline yellow, methylene blue chloride, phthalocyanine blue, malachite green oxalate, lamp black, rose bengal, C.I. pigment red 48:1, C.I. pigment red 122, C.I. pigment red 57:1, C.I. pigment yellow 97, C.I. pigment yellow 12, C.I. pigment blue 15:1, and C.I. pigment blue 15:3.

If necessary, the toner may comprise an additive such as a known charge-control agent or fixation aid.

The average particle diameter of toner is 30 μm or less, preferably from 4 to 20 μm.

When a developer is produced from the toner and carrier, the toner concentration is preferably from 0.3% to 30% by weight.

In the present invention, it is preferable that the developing curve of the developer have a saturated region.

The saturated region is one in which the amount of developer toner moving to the latent image reaches a limit and therefore hardly varies, even if the contrast potential changes, when the contrast potential becomes equal to or greater than a certain value in the developing curve as shown in FIG. 1.

In the present invention, f, which is defined by the equation below, means the percent of coverage of a carrier with toner and is preferably from 20 to 75, although the preferable range varies with the electrical resistance of the developer and the amount of development. If f is smaller than 20, a sufficient image density cannot be obtained and image defects, such as brush marks and carrier beads carry over, tend to occur, whereas if f exceeds 75, a saturated region cannot be obtained.

$$f = \frac{3^{0.5} \times R \times \rho_c \times C}{2\pi \times r \times \rho_t}$$

where R is a volume average particle diameter (μm) of a magnetic carrier, r is a volume average particle diameter (μm) of toner particles, C is a relative concentration of toner (parts by weight of toner mixed with 100 parts by weight of carrier), $\rho_c$ is the specific gravity of the carrier, and $\rho_t$ is the specific gravity of the toner.

In the present invention, an image can be produced by an image-forming method comprising forming a latent image on a latent image substrate, developing the latent image by means of the above developer, transferring the developed toner image to an image-receiving medium, and thermally fixing the toner image on the image-receiving medium.

Further, according to the present invention, the above developer can be used and bias potential for development can be applied to a developer carrying member so that the amount of developer toner moving to a latent image exhibits a saturated characteristic, in an image-forming method comprising the steps of forming a latent image on a uniformly charged latent image substrate based on image data and developing the latent image by a developer held on a developer carrying member provided with a bias potential for development, or in an image-forming apparatus comprising a latent image-forming means for forming a latent image on a latent image substrate, which is uniformly charged, based on image data, and developing means for developing the latent image by a developer held on a developer carrying member provided with bias potential for development.

The saturated characteristic means where the amount of developer toner hardly varies due to changes in contrast potential which is determined by bias potential for development to be applied to the developer carrying member and by the potential of the light-exposed part of the latent image substrate.

For example, bias potential for development can be applied to the developer carrying member so that a value obtained by subtracting $|V_1|$, which is defined as the absolute value of the mean surface potential of the light-exposed part of the photoreceptor when light exposure is performed so that the proportion of the input image area is 100%, from $|V_{bias}|$, which is defined as the absolute value of bias potential for development, exceeds $|V_s|$, which is defined as the absolute value of contrast potential where the slope of the developing curve becomes ⅕or less of the slope at the start of the developing operation. By setting the bias potential for development in the above way, it is possible to stabilize the amount of developer toner and to reproduce an excellent image, even if photoreceptor sensitivity is not uniform.

More specifically, it is preferable to employ bias potential for development obtained by the superimposition on a DC electric field of an AC electric field having a peak-to-peak voltage of 100 to 500 V and a frequency of 400 Hz to 20 kHz.

Figure 2:
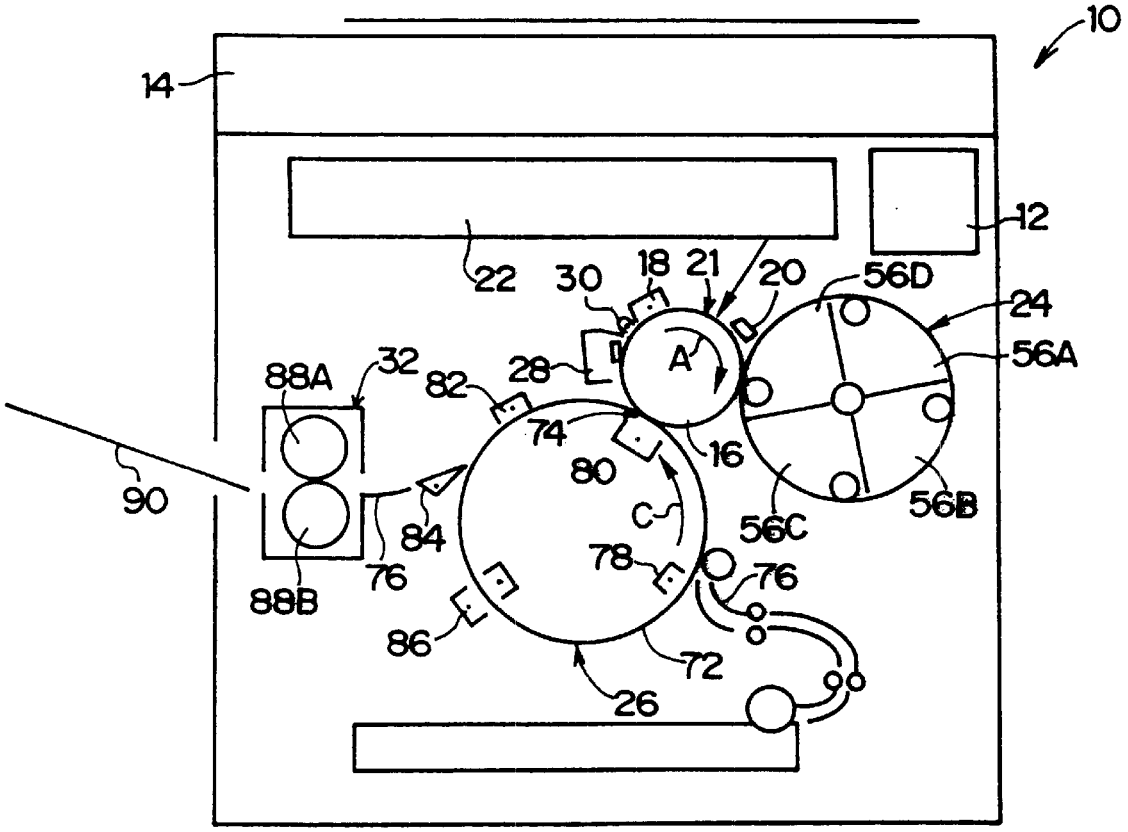
FIG. 2 shows the entire structure of an image-forming apparatus.

FIG. 2 shows an example of image-forming apparatus to which the present invention can be applied.

This image-forming apparatus 10 comprises a controller 12 which controls the entire image-forming apparatus 10; a reader 14 which radiates light to an original and produces image signals for each color from the light transmitted through or reflected from the original irradiated with the light; a photoreceptor 16 which rotates in the direction indicated by arrow A and serves as a latent image substrate; a charger 18 which is positioned near the photoreceptor 16 and provides a uniform electrical charge to the photoreceptor; a potential sensor 20 positioned downstream from the charger 18 in the direction of photoreceptor rotation and measures the potential of the charged photoreceptor 16; a light beam scanner (ROS) 22 which scan-exposes, in accordance with image date from the reader 14, the charged photoreceptor at an exposing area 21 which is positioned upstream from the potential sensor 20 in the direction of photoreceptor rotation, so that a latent image is formed; a rotating developing device 24, which is positioned downstream from the exposing part 21 in the direction of photoreceptor rotation and transfers the toner to the latent image to form a visible image; a transfer device 26, which is positioned downstream from the rotating developing device 24 in the direction of photoreceptor rotation and transfers the visible image to a recording material; a cleaner 18, which is positioned downstream from the transfer device 26 in the direction of photoreceptor rotation and removes the toner remaining on the photoreceptor 16; a preexposure device 30, which preexposes the photoreceptor 16 to eliminate residual potential; and a fixing device 32 which fixes the visible image on the recording material.

The reader 14 comprises an illuminator (not shown) which radiates light to the original; a color filter (not shown) for separating the light, which is transmitted through or reflected from the original irradiated with the light, into different colors; a photoelectric converter (not shown) for converting the light strength of each color into an electric signal, which is analog data, an A/D (analog/digital) converter (not shown) for converting the electrical signal of each color to an image signal for each color, which signal is digital data; and memory (not shown) which stores the image signal for each color. The image signal stored in memory is output in succession for each color to the light beam scanner 22 based on the signals from the controller 12.

Figure 3:
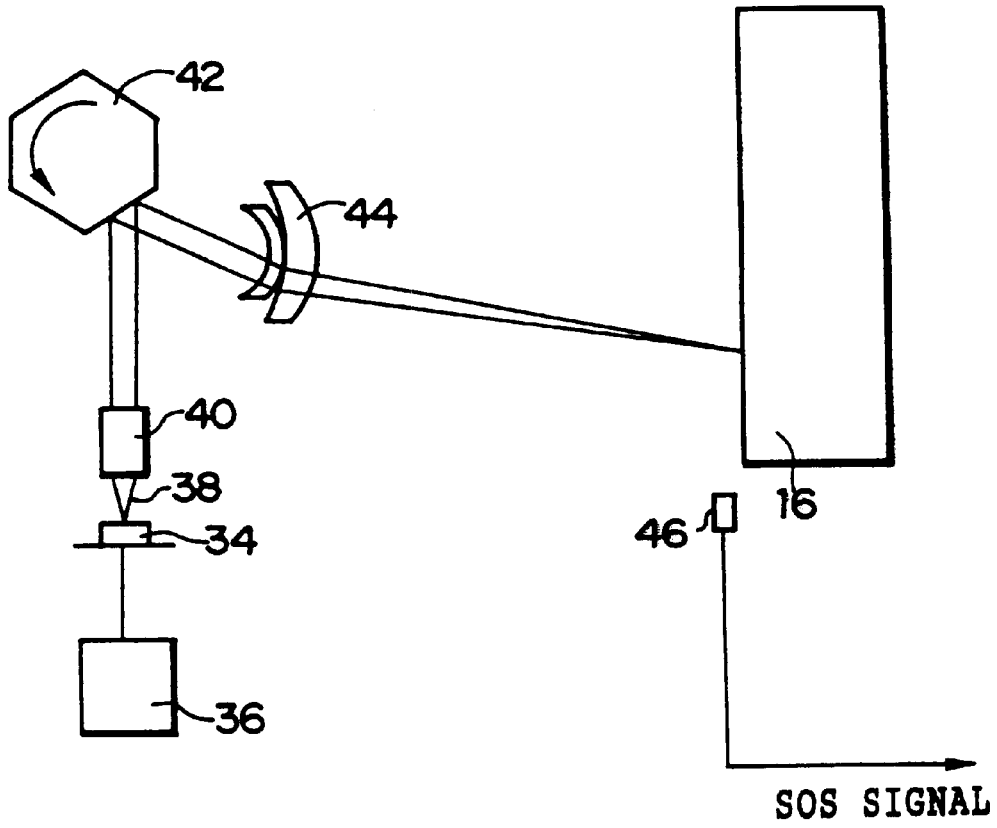
FIG. 3 shows the structure of a light beam scanner which is used in the image-forming apparatus of FIG. 2.

As shown in FIG. 3, the light beam scanner 22 comprises a semiconductor laser 34 which emits a laser beam 38; a pulse-width modulator 36 for turning the semiconductor laser 34 on and off based on the image signal from the reader 14; a collimator lens 40 which makes the laser beam from the semiconductor laser 34 parallel; a polygon mirror 42 which deflects the parallel beam from the collimator lens 40 to the photoreceptor 16 at a conformal speed; an fθ lens 44 which is positioned between the polygon mirror 42 and the photoreceptor 16 and adjusts beam spots into predetermined sizes on the photoreceptor 16; and a sensor 46 generating a scan-start signal to produce an SOS signal for the detection of scan-start timing.

Figure 4:
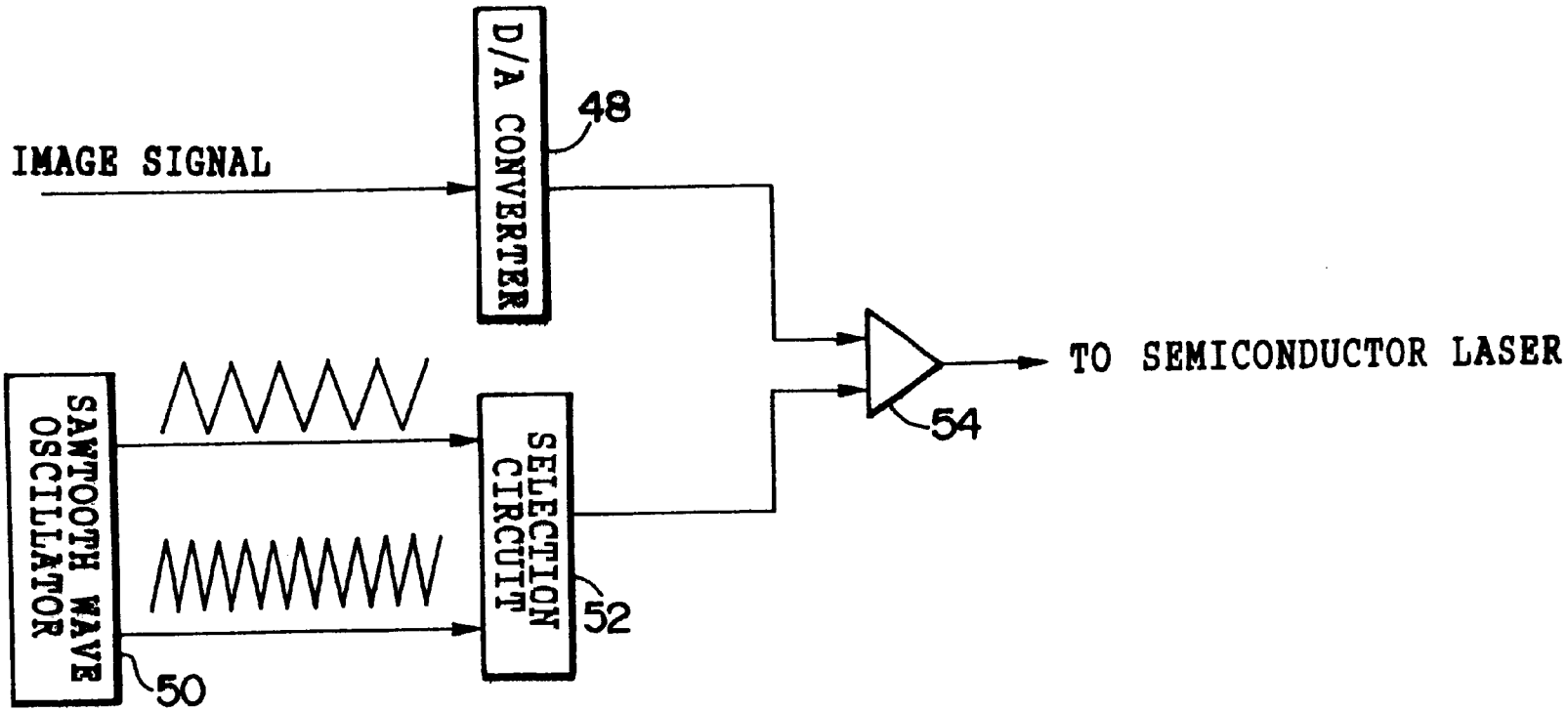
FIG. 4 shows the structure of a pulse-width modulator which is used in the light beam scanner of FIG. 3.

As shown in FIG. 4, the pulse-width modulator 36 comprises an D/A converter 48, for converting an image signal from the reader 14, which signal is digital data, to an electric signal, which is analog data, a sawtooth oscillator 50 for generating a plurality of sawtooth waves having different frequencies; a waveform selection circuit 52 for selecting the sawtooth wave having the desired frequency from the plurality of sawtooth waves generated by the sawtooth oscillator 50 based on the resolution; and a comparator 54 for generating an ON signal to turn the semiconductor laser 34 on if the sawtooth wave voltage output by the waveform selection circuit 52 exceeds the voltage of the electrical signal output from the D/A converter 48. Based on this structure, it is possible to output an ON signal having a duration corresponding to the image density of the original.

Figure 5:
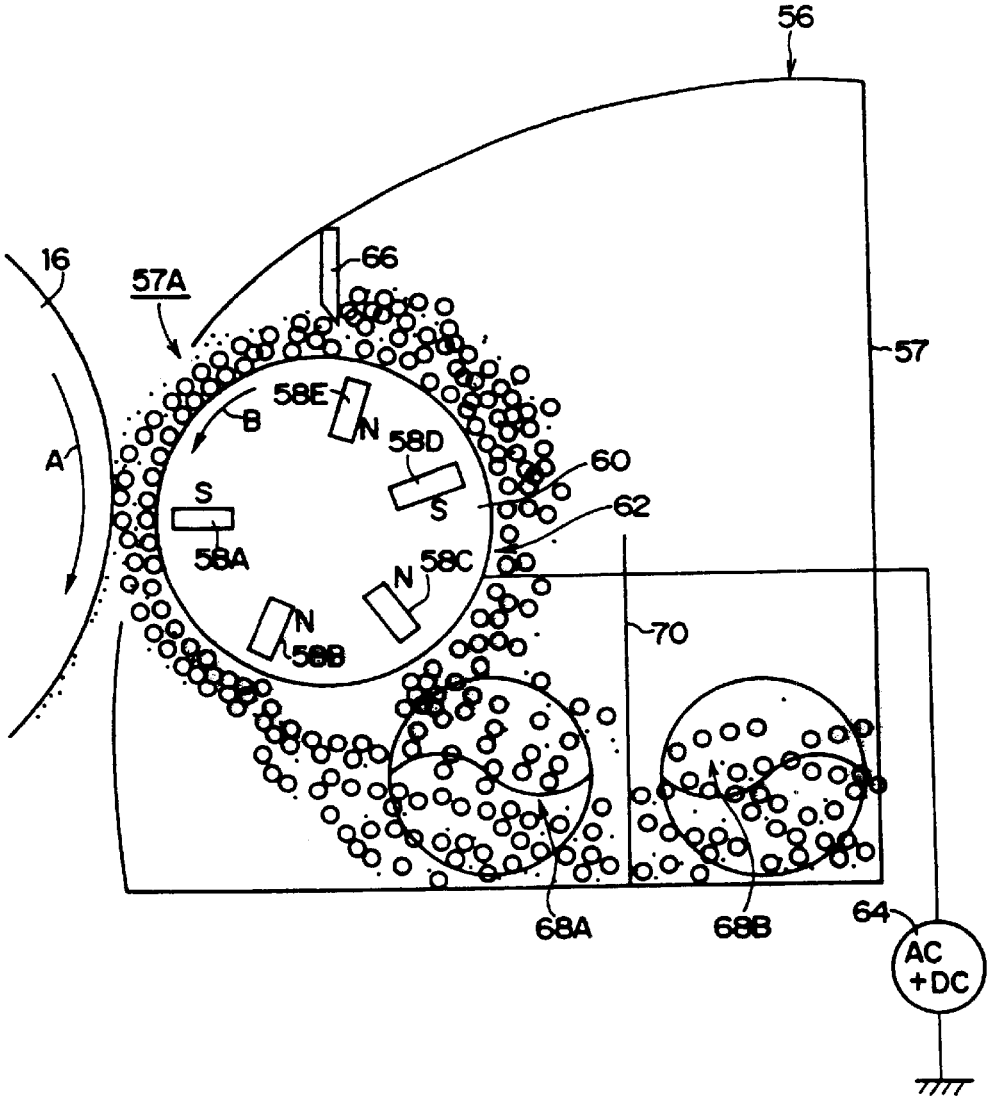
FIG. 5 is a schematic diagram illustrating the development region for a rotating developing device which is used in the image-forming apparatus of FIG. 2.

As shown in FIG. 2, the rotating developing device 24 is cylindrical and is made up of four, i.e., yellow, cyan, magenta, and black, developing parts 56 ( 56A–56D), each based on reversal and a two-component system. FIG. 5 shows an outline of the developing part 56. The developing part 56 comprises a housing for development 57, whose cross section is fan-shaped and which has an opening 57A on the external periphery in the axial direction, a magnetic roller 62 which comprises a plurality of fixed magnets 58 (58A–58E) radially disposed and a sleeve for development 60 rotating around the fixed magnet 58 in the direction indicated by arrow B, a biasing power source 64 which supplies a DC-superimposed AC bias voltage to the sleeve for development 60 to inhibit toner adhesion to the white region, a trimmer bar 66 which is positioned upstream from the opening 57A in the direction of roller rotation and keeps constant the thickness of the magnetic brush composed of the developer, screw augers 68A and 68B which are disposed beneath the magnetic roller 62 and stir the developer, a partition 70 which is positioned between the screw auger 68A and 68B and has an opening at one end (not shown) and a toner feeder which feeds the screw auger 68B with a toner supply, so that the magnetic roller 62, screw augers 68A, 68B, trimmer bar 66, toner feeder, and partition 70 are housed in the housing for development 57.

The magnetic roller 62 is fixed so that the axial direction thereof is parallel to the axial direction of the photoreceptor 16. The rotating developing device 24 is disposed such that when the opening 57A of the housing for development 57 for each developing part 56 faces the photoreceptor 16, a predetermined gap is formed between the magnetic roller 62 accommodated in the developing part 56 and the photoreceptor 16.

As for the polarity of the plurality of the fixed magnets 58, the adjacent fixed magnets 58B and 58C, which are positioned downstream from the opening 57A in the direction of roller rotation, have the same polarity, while other adjacent fixed magnets, i.e., 58C and 58D, 58D, and 58E, 58E, and 58A, and 58A and 58B, have polarity different from each other. Therefore, the magnetic brush, which adheres on the magnetic roller 62 due to the attraction force of the fixed magnets 58C and 58D disposed above the screw auger 68A, is transported, by means of the attraction force of the fixed magnets 58D and 58E, 58E and 58A, and by means of the rotation of the magnetic roller 62, to the opening 57A of the housing for development 57 in order to brush (develop) the photoreceptor 16, while the toner, which remains on the magnetic roller 62, is removed by the repulsive force between the fixed magnets 58B and 58C, and drops down toward the housing for development 57.

The screw augers 68A and 68B rotate in a direction different from each other to pass the developer through an opening formed at the end of the partition 70, so that the supplied toner and carrier are sufficiently mixed to feed the developer to the magnetic roller 62.

The rotating developing device 24 is connected to a driving device (not shown), which is linked to the controller 12, and rotates interruptedly so that, when a latent image for each color is formed, the latent image is developed by means of toner of a corresponding color.

As shown in FIG. 2, the transfer device 26 has a transfer drum 72 rotating in the direction indicated by arrow C. The transfer drum 72 is positioned so that the axial direction thereof is parallel to the axial direction of the photoreceptor 16 and a predetermined gap is formed between the photoreceptor 16 and the transfer drum 72. On the periphery of the transfer drum 72 there are a charger for adsorption 78, which is positioned upstream from the transfer part 74 where the transfer drum 72 and the photoreceptor 16 approach each other in the direction of rotation of the transfer drum 72 and which provides an electrostatic charge to the transfer drum 72 so that the recording material fed from a feed passageway 76 is adsorbed on the transfer drum 72, a charger for transfer 80, which is positioned near the transfer part 74 and which serves to transfer the toner image on the photoreceptor 16 to the transfer drum 72, a charger for removal 82, which is positioned downstream from the charger for transfer 80 in the direction of rotation of the transfer drum 72 and which provides an electrical charge to the transfer drum 72 so that the adsorbed recording material is removed from the transfer drum 72, a finger for removal 84, which is positioned downstream from the charger for removal 82 in the direction of rotation of the transfer drum 72 and which removes the recording material from the transfer drum 72, and a charger for charge removal 86 which is positioned downstream from the finger for removal 84 in the direction of rotation of the transfer drum 72 and which removes the residual charge from the surface of the transfer drum 72.

The fixing device 32 is positioned on a transport passageway 76 and downstream from the finger for removal 84 in the direction of transport and the fixing device 32 comprises a pair of fixing rollers 88A and 88B which are positioned facing each other with the transport passageway 76 between. At least one of the fixing rollers 88A and 88B is heated by a heater (not shown) so that the recording material sent from the transfer device 26 is introduced into the nip portion of the pair of fixing rollers 88A and 88B to be heated at the nip portion to thereby fix a multiple-color image on the recording material.

A tray 90 is positioned downstream from the fixing rollers 88A and 88B in the direction of the transport and a recording material having the image fixed thereon is introduced into the tray 90 by means of the rotation of the fixing rollers 88A and 88B.

In the image-forming apparatus 10, a series of treatments is carried out, that is, the original is read by the reader 14 to produce image signals for each color, and the image signals produced for each color are output in succession to the light beam scanner 22. Meanwhile, the photoreceptor 16 is electrostatically charged and a latent image is formed for each color on the photoreceptor 16 by a light beam scanner 22, and the rotating developing device 24 develops the latent image by means of toner of a corresponding color as the latent image is formed for each color. The toner image, which is obtained by the above-described operation and has a specific color, is adsorbed on the transfer drum 72 and is transferred to a recording material. The repetition of this series of operations, which comprise formation of a latent image, development and transfer for each color, produces a multiple-color image on the recording material. The recording material having the multiple-color image thereon is fed for fixing to the fixing device 32 and finally to the tray 90.

A latent image formed by above image-forming apparatus is one represented by two voltages. The image represented by two voltages is explained below.

Figure 6A:
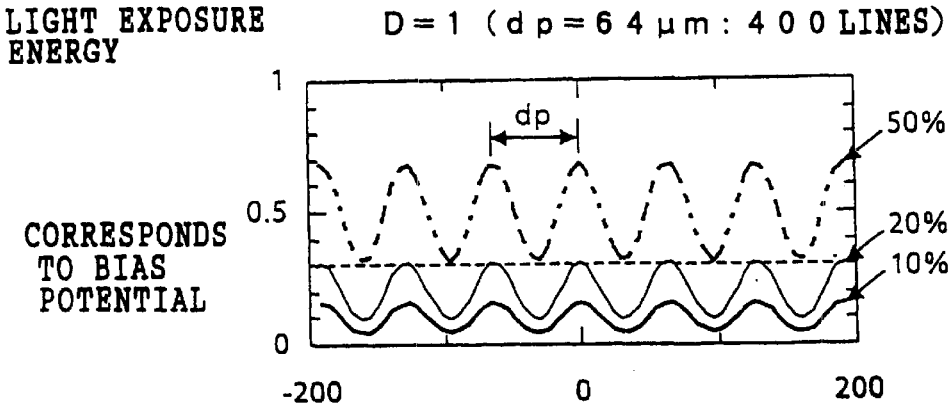
FIG. 6A is the profile of light-exposure energy for a photoreceptor when the value of D (dB/dP), which is the ratio of the distance dP (mm) between adjacent pixels in the principal scanning direction, to the beam spot diameter dB is 1.
Figure 6B:
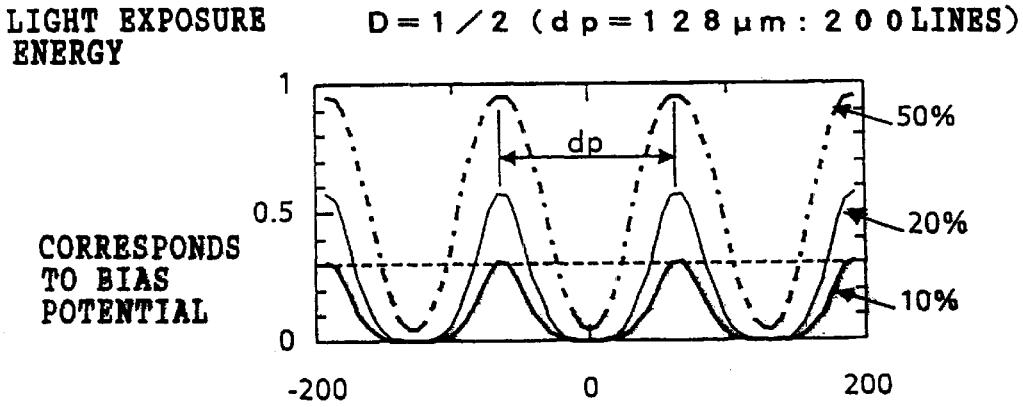
FIG. 6B is the profile of light-exposure energy for a photoreceptor when the value of D (dB/dP), which is the ratio of the distance dP (mm) between adjacent pixels in the principal scanning direction, to the beam spot diameter dB is 1/2.
Figure 6C:
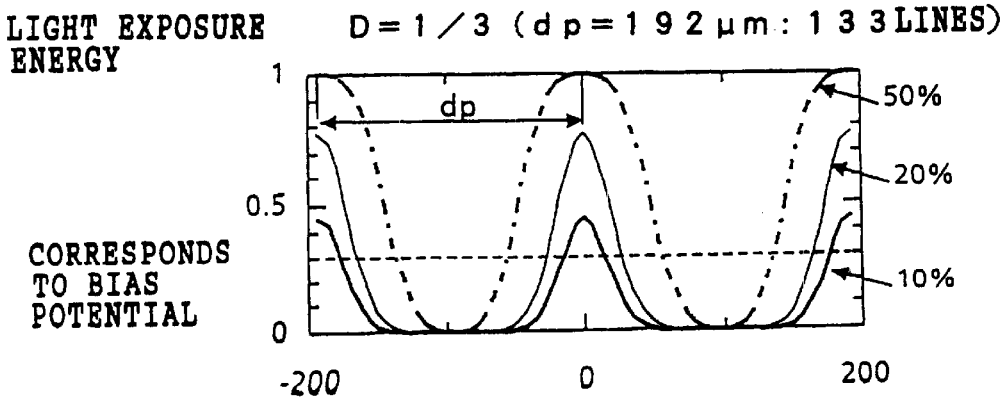
FIG. 6C is the profile of light-exposure energy for a photoreceptor when the value of D (dB/dP), which is the ratio of the distance dP (mm) between adjacent pixels in the principal scanning direction, to the beam spot diameter dB is 1/3.
Figure 7:
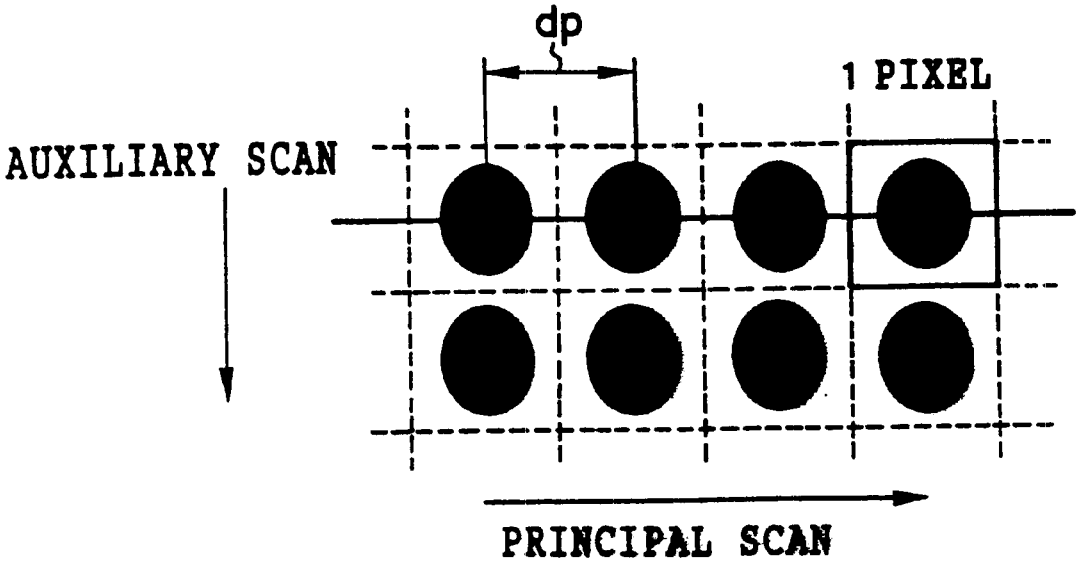
FIG. 7 is a chart of the distance between pixels.

FIG. 6 shows light exposure energy profiles on a photoreceptor exposed by means of a light beam scanner under conditions in which the light beam spot diameter dB (mm) is constant, the value of D (dB/dP), which is the ratio of the distance dP (mm) between adjacent pixels, in the principal scanning direction (see FIG. 7), to the beam spot diameter dB, is 1/1, 1/2, and 1/3, and that the proportions of the input image area are 10%, 20%, and 50%. As is apparent from FIG. 6, as the value of D increases from 1/3, 1/2, to 1/1, the contrast of the light exposure energy profile diminishes.

Figure 8A:
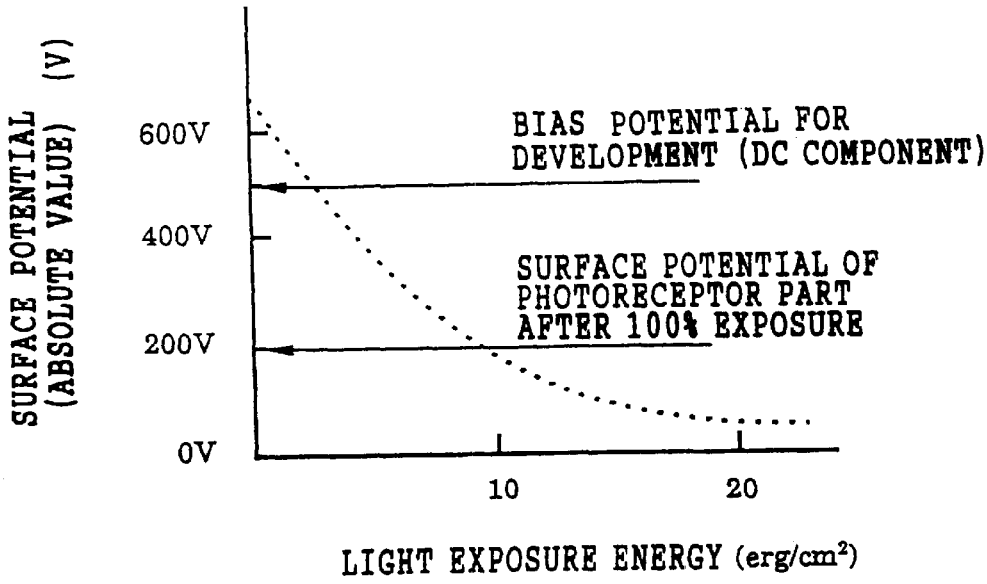
FIG. 8A shows a curve illustrating an attenuation characteristic of the photoelectric potential of a photoreceptor.
Figure 8B:
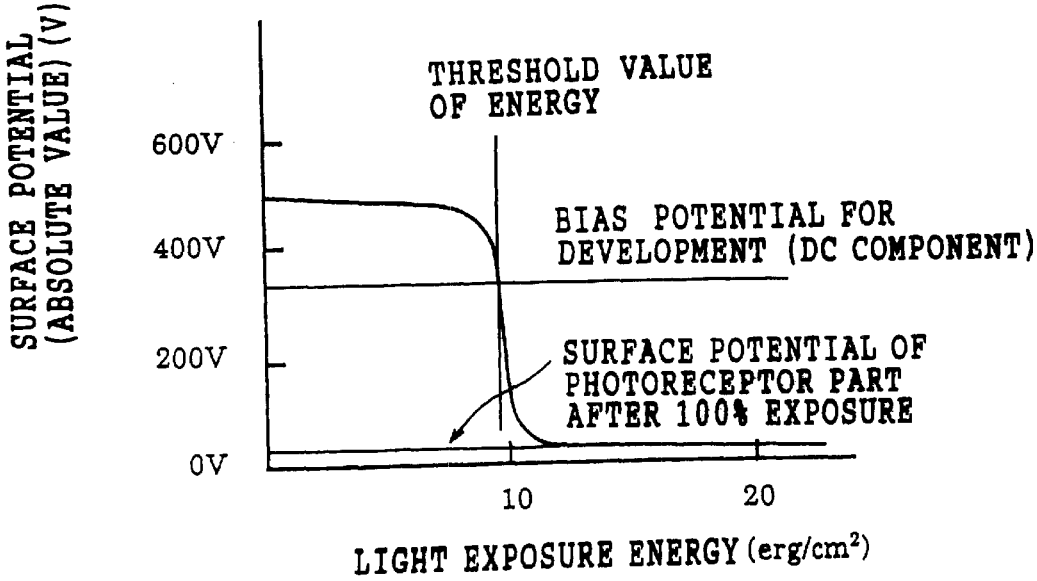
FIG. 8B shows another curve illustrating an attenuation characteristic of the photoelectric potential of a photoreceptor.
Figure 9A:
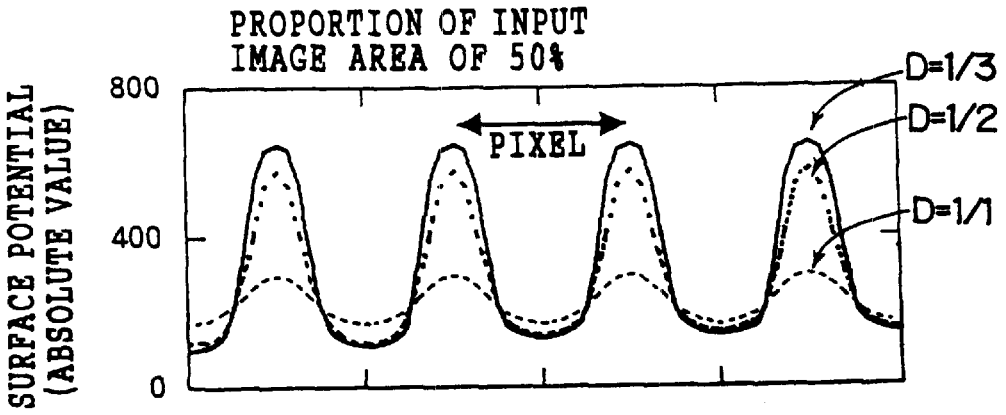
FIG. 9A shows a surface potential profile, which is calculated under the condition that a photoreceptor having an attenuation characteristic of the photoelectric potential shown in FIG. 8A is exposed according to the light-exposure energy profiles shown in FIG. 6 so that the proportion of the input image area is 50% while the value of D varies, of the photoreceptor.

FIGS. 8A and 8B show attenuation characteristics of the photoelectric potential of a photoreceptor. FIG. 9A shows a surface potential profile, which is calculated under the condition that a photoreceptor having an attenuation characteristic of the photoelectric potential shown in FIG. 8A is exposed according to the light-exposure energy profiles shown in FIG. 6 so that the proportion of the input image area is 50%, while the value of D varies, of the photoreceptor. The calculation method is described, for example, in Proceedings IS &T's 6th International Congress on Advances in Nonimpact Printing Technologies, Vol. 9, pp. 97–100, 1993.

As is apparent from FIG. 9A, as the value of D increases, the contrast of the light exposure energy profile diminishes, as does the contrast of the surface potential profile of the latent image.

In the present invention, a latent image represented by two voltages means that the contrast potential of a latent image $|V_a-V_b|$, which is produced by the surface potential of $V_a$ of the exposed part (the part to be exposed) and the surface potential of $V_b$ of the unexposed part (the part not to be exposed) when exposure is carried out so that the proportion of the input image area is 50%, is 90% or more of the contrast potential of a latent image $|V_h-V_l|$, which is produced by the electrostatic potential of $V_h$ of the photoreceptor and the average surface potential of $V_l$ of the exposed part of the photoreceptor when exposure is carried out so that the proportion of the input image area is 100%.

Accordingly, a latent image represented by two voltages can be obtained by adopting D having a value of ½ or less when a photoreceptor, which has a photoelectric potential attenuation characteristic shown in FIG. 8A, is used.

Figure 9B:
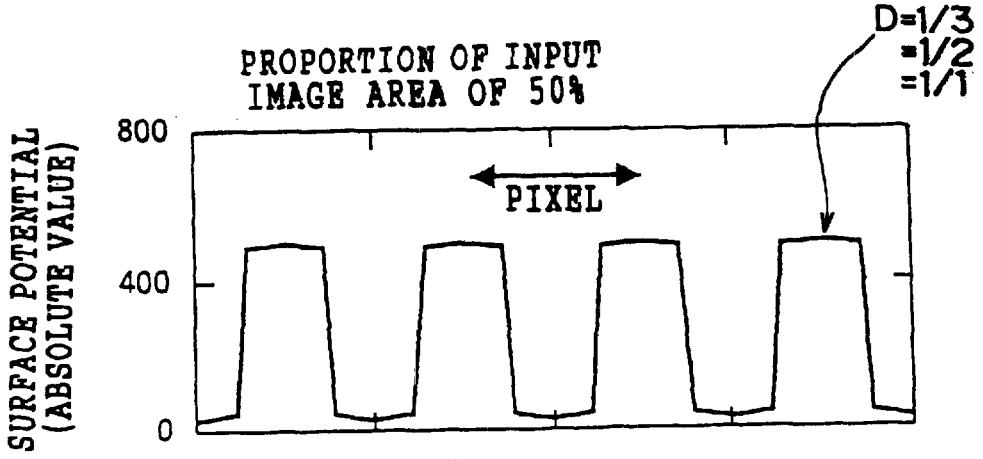
FIG. 9B shows a surface potential profile, which is calculated under the condition that a photoreceptor having an attenuation characteristic of the photoelectric potential shown in FIG. 8B is exposed according to the light-exposure energy profiles shown in FIG. 6 so that the proportion of the input. image area is 50% while the value of D varies, of the photoreceptor.

Further, a latent image represented by two voltages can be obtained when a photoreceptor, which has a photoelectric potential attenuation characteristic shown in FIG. 8B, even if D is 1 as shown in FIG. 9B, by appropriately adjusting the exposure energy.

EXAMPLES

The present invention is further explained using the examples and comparative examples which follow.

Preparation of Carriers

The dynamic electrical resistance of the carrier was obtained as follows: About 30 $cm^3$ of a carrier was placed on a developing roller to form a magnetic brush, which was made to face a plate electrode having an area of 3 $cm^2$ with a gap of 2.5 mm therebetween. A voltage was applied between the developing roller and the plate electrode while rotating the developing roller at 120 rpm to measure the electric current. The resistance was obtained from the measured current and the applied voltage according to the Ohm's law.

EXAMPLE 1

Carrier A

Magnetite (MX030A; average particle diameter: 50 $\mu$m, manufactured by Fuji Electrochemical Co., Ltd.)
100 parts by weight Toluene
13.5 parts by weight Styrene/methyl methacrylate copolymer (monomer ratio: 20:80; Mw: 73,000)
1.8 parts by weight Carbon black (VXC 72, $10^{-1}$ Ω·cm, particle diameter: 30 nm, manufactured by Cabot Co.)
0.3 parts by weight All of the above-identified ingredients except for the magnetite particles were dispersed by a sand mill for one hour to prepare a solution for forming a coating layer. The solution and magnetite particles. were placed in a kneader equipped with a vacuum deaerator. The contents were stirred for 20 minutes at 60° C. under a reduced pressure to obtain particles of Carrier A having a resin coating layer on the magnetite. The resin coating layer was 0.8 μm thick. The carbon black (VXC 72) content of the resin coating layer was 8% by volume.

Carrier A was observed under a scanning electron microscope (SEM) and the result showed that the magnetite was coated uniformly with the resin without exposed surface. The solution was coated onto an electroconductive ITO glass base by an applicator to obtain a resin coating film 0.8 μm thick.

Figure 10:
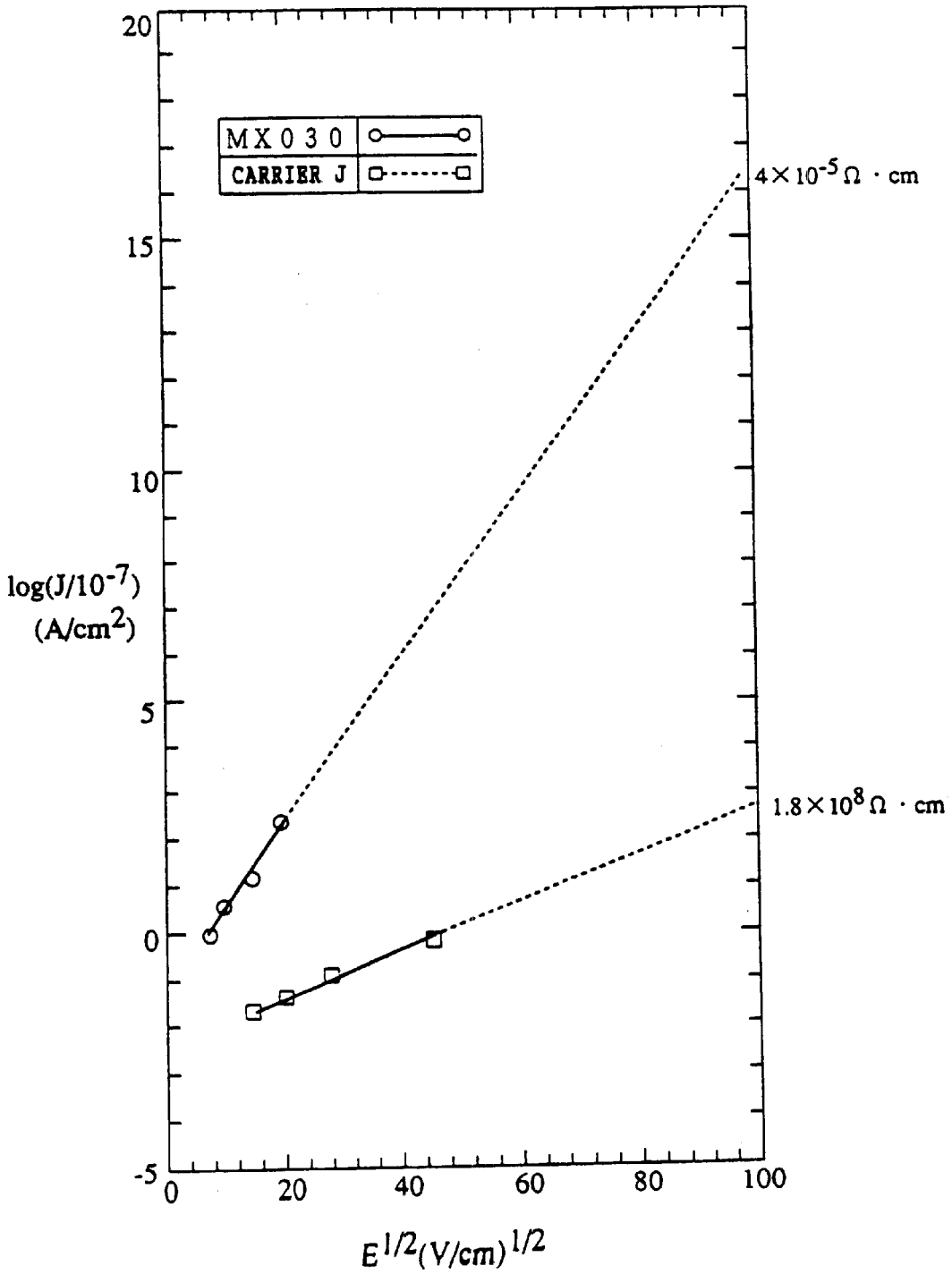
FIG. 10 is a graph indicating the relationship between current density J and applied electric field E, when electrical resistance of a magnetic brush (extrapolated to that under an electric field of $10^4$ V/cm) was measured when the magnetic brush was formed only of the carrier of Example 1.

Respective magnetic brushes were formed only of the magnetite or Carrier A, and the electrical resistances of the magnetite or Carrier A forming the respective magnetic brushes were measured. Results are shown in FIG. 10. The electrical resistances, to which under the electric field of $10^4$ V/cm actural resistances were extrapolated, of the magnetite and Carrier A were $4\times10^{-5}$ Ω·cm and $1.8\times10^{8}$ Ω·cm respectively. The electrical resistance of the resin coating layer was $3\times10^{5}$ Ω·cm under an electric field of 100 V/cm.

EXAMPLE 2

Carrier B

Ferrite (MF-35; average particle diameter: 35 μcm, manufactured by Powdertech Co., Ltd.)
100 parts by weight Toluene
22 parts by weight Styrene/methyl methacrylate copolymer (monomer ratio: 20:80; Mw: 73,000 )
3 parts by weight Carbon black (Monarch 880, $10^{-1}$ Ω·cm, particle diameter: 16 nm, manufactured by Cabot Co.)
0.8 parts by weight All of the above-identified ingredients except for the ferrite particles were dispersed by a sand mill for one hour to prepare a solution for forming a coating layer. The solution and the ferrite particles were placed in a kneader equipped with a vacuum deaerator. The contents were stirred for 20 minutes at 60° C. under a reduced pressure to obtain particles of Carrier B having a resin coating layer on the ferrite. The resin coating layer was 0.8 μm thick. The carbon black (Monarch 880 ) content of the resin coating layer was 13% by volume.

Carrier B was observed under an SEM and the result showed that the ferrite was coated uniformly with the resin without exposed surface. The solution was coated onto an electroconductive ITO glass base by an applicator to obtain a resin coating film 0.8 μm thick.

Respective magnetic brushes were formed only of the ferrite or Carrier B, and the electrical resistances of the ferrite or Carrier B forming the respective magnetic brushes were measured. The electrical resistances, to which under the electric field of $10^4$ V/cm actural resistances were extrapolated, of the ferrite and Carrier B were $5\times10^{-2}$ Ω·cm and $4\times10^{7}$ Ω·cm respectively. The electrical resistance of the resin coating layer was $2\times10^{3}$ Ω·cm under an electric field of 100 V/cm.

EXAMPLE 3

Carrier C

Ferrite (C28-FB; average particle diameter:50 μm, manufactured by Fuji Electrochemical Co., Ltd.)
100 parts by weight Toluene
14 parts by weight Styrene/methyl methacrylate copolymer (monomer ratio: 20:80; Mw:73,000
2 parts by weight Tin oxide (Passtran Type-IV; 1 Ω·cm; particle diameter: 100 nm, manufactured by Mitsui Metal Corp.)
2 parts by weight All of the above-identified ingredients except for the ferrite particles were dispersed by a sand mill for one hour to prepare a solution for forming a coating layer. The solution and ferrite particles were placed in a kneader equipped with a vacuum deaerator. The contents were stirred for 20 minutes at 60° C. under a reduced pressure to obtain particles of Carrier C having a resin coating layer on the ferrite. The resin coating layer was 0.8 μm thick. The tin oxide (Passtran Type-IV) content of the resin coating layer was 13% by volume.

Carrier C was observed under an SEM and the result showed that the ferrite was coated uniformly with the resin without exposed surface. The solution was coated onto an electroconductive ITO glass base by an applicator to obtain a resin coating film 0.8 μm thick.

Respective magnetic brushes were formed only of the ferrite or Carrier C, and the electrical resistances of the ferrite or carrier C forming the respective magnetic brushes were measured. The electrical resistances, to which under the electric field of $10^4$ V/cm actural resistances were extrapolated, of the ferrite and Carrier C were $1\times10^{-5}$ Ω·cm and $2\times10^{6}$ Ω·cm respectively. The electrical resistance of the resin coating layer was $6\times10^{4}$ Ω·cm under an electric field of 100 V/cm.

EXAMPLE 4

Carrier D

Iron powder (TSV; average particle diameter: 60 μm, manufactured by Powdertech Co., Ltd.)
100 parts by weight Toluene
8 parts by weight Styrene/methyl methacrylate copolymer (monomer ratio: 20:80; Mw: 73,000)
1 part by weight Carbon black (VXC 72; $10^{-1}$ Ω·cm; particle diameter: 30 nm, manufactured by Cabot Co.)
0.2 parts by weight All of the above-identified ingredients except for the iron powder were dispersed by a sand mill for one hour to prepare a solution for forming a coating layer. The solution and iron powder were placed in a kneader equipped with a vacuum deaerator. The contents were stirred for 20 minutes at 60° C. under a reduced pressure to obtain particles of Carrier D having a resin coating layer on the iron powder. The resin coating layer was 0.8 μm thick. The carbon black (VXC 72) content of the resin coating layer was 10% by volume.

Carrier D was observed under an SEM and the result showed that the iron powder was coated uniformly with the resin without exposed surface. The solution was coated onto an electroconductive ITO glass base by an applicator to obtain a resin coating film 0.8 μm thick.

Respective magnetic brushes were formed only of the iron powder or Carrier D, and the electrical resistances of the iron powder or Carrier D forming the respective magnetic brushes were measured. The electrical resistances, to which under the electric field of $10^4$ V/cm actural resistances were extrapolated, of the iron powder and Carrier D were $1\times10^{-14}$ Ω·cm and $2\times10^3$ Ω·cm respectively. The electrical resistance of the resin coating layer was $8\times10^3$ Ω·cm under an electric field of 100 V/cm.

Comparative Example 1

Carrier E

Ferrite (C28-FB; average particle diameter: 50 μm, manufactured by Fuji Electrochemical Co., Ltd.)
100 parts by weight Toluene
14.5 parts by weight Styrene/methyl methacrylate copolymer (monomer ratio: 20:80; Mw: 73,000)
2 parts by weight The resin solution, prepared by dissolving the resin in toluene, and ferrite were placed in a kneader equipped with a vacuum deaerator. The contents were stirred for 20 minutes at 60° C. under a reduced pressure to obtain particles of Carrier E having a resin coating layer on the ferrite. The resin coating layer was 0.8 μm thick.

Carrier E was observed under an SEM and the result was that the ferrite was coated uniformly with the resin without exposed surface. The solution was coated onto an electroconductive ITO glass base by an applicator to obtain a resin coating film 0.8 μm thick.

Magnetic brush was formed only of Carrier E, and the electrical resistance of Carrier E forming the magnetic brush was measured. The electrical resistance of Carrier E was $6.3\times10^{10}$ Ω·cm under an electric field of $10^4$ V/cm but the electrical resistance was $1.0\times10^{11}$ Ω·cm under an electric field of 400 V/cm and $9.8\times10^{10}$ Ω·cm under an electric field of 4,000 V/cm. The electrical resistance of the resin coating layer was $1\times10^{13}$ Ω·cm under an electric field of 100 V/cm. As is apparent from the results of this comparative example, no abrupt change in resistance due to the change in electric field strength was observed in a carrier made up of a low-resistance core uniformly coated with a high-resistance resin.

EXAMPLE 5

Carrier F

Ferrite (C28-FB; average particle diameter: 50 μm, manufactured by Fuji Electrochemical Co., Ltd.)
100 parts by weight Toluene
12.3 parts by weight Styrene/methyl methacrylate copolymer (monomer ratio: 20:80; Mw: 73,000)
0.43 parts by weight Carbon black (VXC 72; $10^{-1}$ Ω·cm; particle diameter: 30 nm, manufactured by Cabot Co.)
0.07 parts by weight All of the above-identified ingredients except for the ferrite particles were dispersed by a sand mill for one hour to prepare a solution for forming a coating layer. The solution and ferrite particles were placed in a kneader equipped with a vacuum deaerator. The contents were stirred for 20 minutes at 60° C. under a reduced pressure to obtain particles of Carrier F having a resin coating layer on the ferrite. The resin coating layer was 0.2 μm thick. The carbon black (VXC 72) content of the resin coating layer was 8% by volume as in Example 1. Carrier F was observed under an SEM and the result was that the ferrite surface was partly exposed. The solution was coated onto an electroconductive ITO glass base by an applicator to obtain a resin coating film 0.8 μm thick.

Magnetic brush was formed only of Carrier F, and the electrical resistance of Carrier F forming the magnetic brush was measured. The electrical resistance, to which under the electric field of $10^4$ V/cm actual resistance was extrapolated, of Carrier F was $4.2\times10^6$ Ω·cm. The electrical resistance of the resin coating layer was $3\times10^5$ Ω·cm under an electric field of 100 V/cm.

EXAMPLE 6

Carrier I

Ferrite (C28-FB; average particle diameter: 50 μm, manufactured by Fuji Electrochemical Co., Ltd.)
100 parts by weight Toluene
14 parts by weight Diethylaminoethyl methacrylate/styrene/methyl methacrylate terpolymer (monomer ratio: 2:20:78; Mw: 70,000)
1 part by weight Perfluorooctyl methacrylate/methyl methacrylate copolymer (monomer ratio: 40:60; Mw:68,000)
1 part by weight Tin oxide (Passtran Type-IV; $6\times10^4$ Ω·cm; particle diameter: 100 nm, manufactured by Mitsui Metal Corp.)
6.1 part by weight All of the above-identified ingredients except for the ferrite particles were dispersed by a sand mill for one hour to prepare a solution for forming a coating layer. The solution and ferrite particles were placed in a kneader equipped with a vacuum deaerator. The contents were stirred for 20 minutes at 60° C. under a reduced pressure to obtain particles of Carrier I having a resin coating layer on the ferrite. The resin coating layer was 0.8 μm thick. The tin oxide (Passtran Type-IV) content of the resin coating layer was 40% by volume. Carrier I was observed under an SEM and the result was that the ferrite was coated uniformly with the resin without exposed surface. The solution was coated onto an electroconductive ITO glass base by an applicator to obtain a resin coating film 0.8 μm thick.

Respective magnetic brushes were formed only of the ferrite or Carrier I, and the electrical resistances of the ferrite or Carrier I forming the respective magnetic brushes were measured. The electrical resistances, to which under the electric field of $10^4$ V/cm actural resistances were extrapolated, of the ferrite and Carrier I were $1\times10^{-5}$ Ω·cm and $4\times10^6$ Ω·cm respectively. The electrical resistance of the resin coating layer was $7\times10^4$ Ω·cm under an electric field of 100 V/cm. The contact angle between the resin coating layer and water was measured by Contact Angle Meter CA-A (manufactured by Kyowa Interface Science Co., Ltd.) and the value obtained was 111°.

Comparative Example 2

Carrier G

Ferrite (F-300; average particle diameter: 50 μm, manufactured by Powdertech Co., Ltd.)
100 parts by weight Toluene
12.3 parts by weight Styrene/methyl methacrylate copolymer (monomer ratio: 20:80; Mw: 73,000)
1.7 parts by weight Carbon black (VXC 72; $10^{-1}$ Ω·cm; particle diameter: 30 nm, manufactured by Cabot Co.)
0.6 parts by weight All of the above-identified ingredients except for the ferrite particles were dispersed by a sand mill for one hour to prepare a solution for forming a coating layer. The solution and ferrite particles were placed in a kneader equipped with a vacuum deaerator. The contents were stirred for 20 minutes at 60° C. under a reduced pressure to obtain particles of Carrier G having a resin coating layer on the ferrite. The resin coating layer was 0.8 μm thick. The carbon black (VXC 72) content of the resin coating layer was 16% by volume.

Carrier G was observed under an SEM and the result showed that the ferrite was coated uniformly with the resin without exposed surface. The solution was coated onto an electroconductive ITO glass base by an applicator to obtain a resin coating film 0.8 μm thick.

Respective magnetic brushes were formed only of the ferrite or Carrier G, and the electrical resistances of the ferrite or Carrier G forming the respective magnetic brushes were measured. The electrical resistances of the ferrite and Carrier G were $9.1\times10^7$ Ω·cm (found) and $1\times10^2$ Ω·cm (obtained by extrapolation), respectively. The electrical resistance of the resin coating layer was $3\times10^0$ Ω·cm under an electric field of 100 V/cm.

Comparative Example 3

Carrier H

Ferrite (EFC-50B; average particle diameter: 50 μm, manufactured by Powdertech Co., Ltd.)
100 parts by weight Toluene
12.6 parts by weight Styrene/methyl methacrylate copolymer (monomer ratio: 20:80; Mw: 73,000)
1.7 parts by weight Carbon black (VXC 72; $10^{-1}$ Ω·cm; particle diameter: 30 nm, manufactured by Cabot Co.)
0.55 parts by weight All of the above-identified ingredients except for the ferrite particles were dispersed by a sand mill for one hour to prepare a solution for forming a coating layer. The solution and ferrite particles were placed in a kneader equipped with a vacuum deaerator. The contents were stirred for 20 minutes at 60° C. under a reduced pressure to obtain particles of Carrier H having a resin coating layer on the ferrite. The resin coating layer was 0.8 μm thick. The carbon black (VXC 72) content of the resin coating layer was 15% by volume. Carrier H was observed under an SEM and the result showed that the ferrite was coated uniformly with the resin without exposed surface. The solution was coated onto an electroconductive ITO glass base by an applicator to obtain a resin coating film 0.8 μm thick.

Respective magnetic brushes were formed only of the ferrite or Carrier H, and the electrical resistances of the ferrite or Carrier H forming the respective magnetic brushes were measured. The electrical resistances, to which under the electric field of $10^4$ V/cm actural resistances were extrapolated, of the ferrite and Carrier H were $1\times10^2$ Ω·cm and $8\times10^4$ Ω·cm respectively. The electrical resistance of the resin coating layer was $1\times10^0$ Ω·cm under an electric field of 100 V/cm.

Toner Preparation:

Linear polyester resin
100 parts by weight (linear polyester obtained from terephthalic acid/bisphenol A ethylene oxide adduct/cyclohexane dimethanol; Tg: 62° C.; Mn: 4,000; Mw: 12,000; acid value: 12; hydroxyl value: 25) Magenta pigment (C.I. Pigment Red 57)
3 parts by weight The above-identified ingredients were blended in an extruder, and the blend was pulverized by a jet mill. The resultant powder was treated by a dispenser using wind force to obtain particles of magenta toner of $d_{50}$=7 μm.

Image Quality Evaluation

Developers, which corresponded to each of the carriers prepared in Examples 1–5 and in Comparative Examples 1–3, were prepared by blending 8 parts by weight of the above-described magenta toner with 100 parts by weight of each of the carriers prepared in Examples 1–5 and in Comparative Examples 1–3. Using these developers, a copying test was conducted by an A-Color 630 copy machine used in electrostatic photography manufactured by Fuji Xerox Co., Ltd. Under conditions of 22° C. and 55% relative humidity.

Image Density

A copy was taken from an original having a solid image (20× 20 $mm^2$) and a density of 1.30. On the copy, a reflective density of the image relative to white paper was measured by a Macbeth densitometer. A density of 1.20 or greater was evaluated as acceptable. The evaluation was conducted at the first (initial) copy and at the 50,000th copy.

Density Uniformity

The density uniformity of output images was visually inspected and compared with a standard limit. A rating of ○ was given to a uniform density, while a rating of × was given to a nonuniform density. The evaluation was conducted at the first (initial) copy.

Brush Marks

The number of white lines which were observed under a microscope within a width of 5 mm at a right angle to forward direction was counted. The evaluation was conducted at the first (initial) copy.

Carrier Beads Carry Over (CBCO)

Output images were visually inspected. A rating of ○ was given to an image free of carrier beads carry over, while a rating of × was given to an image with carrier beads carry over. The evaluation was conducted at the first (initial) copy.

Results are shown in Table 1.

TABLE 1

| | | Image density | | Density | Brush marks | |
|---|---|---|---|---|---|---|
| Example | Carrier | 1st copy | 50,000th copy | non-uniformity | (units/5 mm) | CBCO |
| 1 | A | 1.32 | 1.22 | ○ | 0 | ○ |
| 2 | B | 1.34 | 1.22 | ○ | 0 | ○ |
| 3 | C | 1.3 | 1.19 | ○ | 0 | ○ |
| 4 | D | 1.31 | 1.12 | ○ | 0 | ○ |
| CE 1 | E | 1.08 | 0.96 | X | 0 | ○ |
| 5 | F | 1.2 | 1.02 | Δ | 1 | ○ |
| CE 2 | G | 1.15 | 1.04 | X | 10 | X |
| CE 3 | H | 1.17 | 1.04 | X | 8 | X |
| 6 | I | 1.33 | 1.32 | ○ | 0 | ○ |

CE: Comparative example

As is apparent from the table, if the carriers (A, B, C and D) according to the present invention were used, a solid, high-density image was obtained and nonuniformity of density was observed. No brush marks or carrier beads carry over was observed. On the other hand, if Carrier E, which was made up of a low-resistance core uniformly coated with a high-resistance resin, was used, a nonuniformity of density was observed in the central part and the periphery of a solid image and the density of the image was low, although no brush marks or carrier beads carry over was observed. This is because the excessively high electrical resistance of the coating resin layer causes the resistance of the carrier to become higher than desirable, and a phenomenon ascribed to IMB presumably results. Carrier F of an example, which was made-up of a lower-resistance core uniformly coated with a thinner layer of an intermediate-resistance resin compared to the carrier of Example 1, produces slight brush marks. Such brush marks are presumably due to leakage from the exposed area of the core, although the carrier resistance is within the desired range.

Meanwhile, if Carrier G of one of the comparative examples, which was made up of a high-resistance core coated with a low-resistance resin layer, was used, brush marks and carrier beads carry over were observed and the image had a low density together with a nonuniformity of density. Also, if Carrier H of one of the comparative examples, which was made up of an intermediate resistance core coated with a low-resistance resin layer, was used, brush marks and carrier beads carry over were observed and the image had a low density together with a nonuniformity of density. These image defects are presumably due to a too low resin coating layer resistance, although the carrier resistance is within the desired range. Contrary to the unstable performance of the above carriers (A–D), Carrier I, which comprises a water-repellent resin coating layer containing 40% by volume of an electroconductive powder dispersed therein, exhibits stable performance.

The above results indicate that a carrier, whose resistance is controlled within a specific range by uniformly coating a low-resistance core with a layer of an intermediate-resistance resin, produces a high-quality image free of image defects.

EXAMPLES 7–10

Comparative Examples 4–6

The carriers and developers used in the present invention were prepared as follows:

I. Carrier Preparation

Carrier J

Magnetite (MX030A; average particle diameter: 50 μm; manufactured by Fuji Electrochemical Co., Ltd.)
100 parts by weight Toluene
13.5 parts by weight Styrene/methyl methacrylate copolymer (monomer ratio: 20:80; Mw: 73,000)
1.8 parts by weight Carbon black (VXC 72; electrical resistance: $10^{-1}$ Ω·cm, specific gravity:1.8, manufactured by Cabot Co.)
b 0.3parts by weight (8.5% by volume of resin coating layer)

All of the above-identified ingredients except for the magnetite particles were dispersed by a sand mill for one hour to prepare a solution for forming a coating layer. The solution and magnetite particles were placed in a kneader equipped with a vacuum deaerator. The contents were stirred for 20 minutes at 60° C. under a reduced pressure to obtain particles of Carrier J having a resin coating layer on the magnetite. The resin coating layer was 0.8 μm thick.

The solution was coated onto an electroconductive ITO glass base by an applicator to obtain a resin coating film 10 μm thick.

Figure 11:
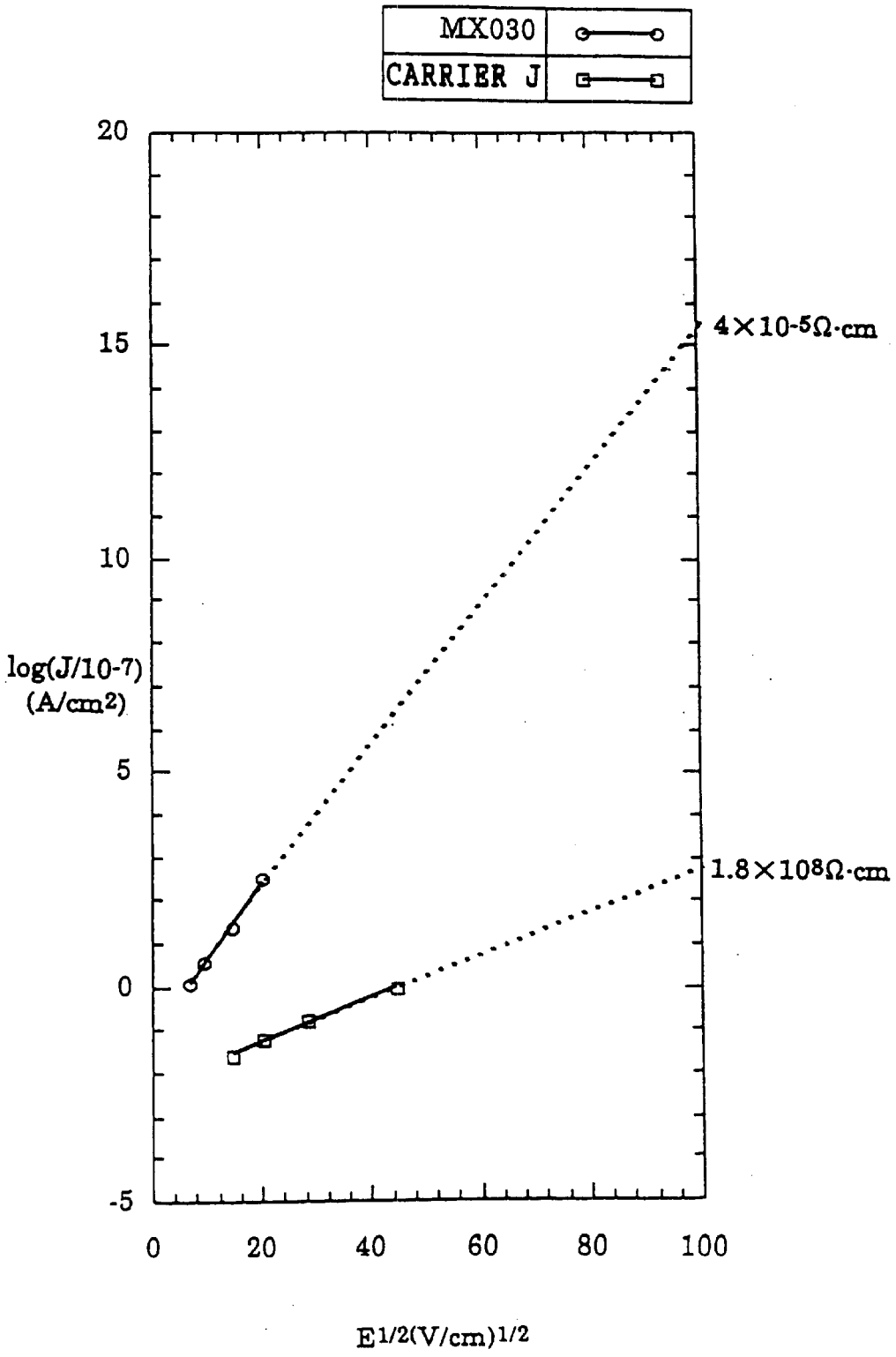
FIG. 11 is a graph indicating the relationship between current density J and applied electric field E, when electrical resistances of magnetic brushes (extrapolated to those under an electric field of $10^4$ V/cm) were measured when the magnetic brushes were formed only of the carrier or the core thereof of the present invention respectively.

Respective magnetic brushes were formed only of the magnetite or Carrier J, and the electrical resistances of the magnetite or Carrier J forming the respective magnetic brushes were measured. Results are shown in FIG. 11. The electrical resistances, to which under the electric field of $10^4$ V/cm actural resistances were extrapolated, of the magnetite and Carrier J were $4\times10^{-5}$ Ω·cm and $1.8\times10^8$ Ω·cm respectively. The electrical resistance of the resin coating layer was $3\times10^5$ Ω·cm under an electric field of 100 V/cm.

Carrier K

Ferrite (MF-35; average particle diameter: 35 μm, manufactured by Powdertech Co., Ltd.)
100 parts by weight Toluene
22 parts by weight Styrene/methyl methacrylate copolymer (monomer ratio: 20:80; Mw: 73,000)
3 parts by weight Carbon black (Ketjen black, electrical resistance: $10^{-1}$ Ω·cm, specific gravity: 1.8, manufactured by Akzo Co.)
0.8 parts by weight (13% by volume of resin coating layer)

All of the above-identified ingredients except for the ferrite particles were dispersed by a sand mill for one hour to prepare a solution for forming a coating layer. The solution and ferrite particles were placed in a kneader equipped with a vacuum deaerator. The contents were stirred for 20 minutes at 60° C. under a reduced pressure to obtain particles of Carrier K having a resin coating layer on the ferrite. The resin coating layer was 0.8 μm thick.

The solution was coated onto an electroconductive ITO glass base by an applicator to obtain a resin coating film 10 μm thick.

Respective magnetic brushes were formed only of the ferrite or Carrier K, and the electrical resistances of the ferrite or Carrier K forming the respective magnetic brushes were measured. The electrical resistances, to which under the electric field of $10^4$ V/cm actural resistances were extrapolated, of the ferrite and Carrier K were $5\times10^{-2}$ Ω·cm and $4\times10^7$ Ω·cm respectively. The electrical resistance of the resin coating layer was $2\times10^3$ Ω·cm under an electric field of 100 V/cm.

Carrier L

Ferrite (C28-FB; average particle diameter: 50 μm, manufactured by Fuji Electrochemical Co., Ltd.)
100 parts by weight Toluene
14 parts by weight Styrene/methyl methacrylate copolymer (monomer ratio: 20:80; Mw: 73,000)
2 parts by weight Tin oxide-coated barium sulfate (Passtran Type-IV, electrical resistance: 5 Ω·cm; specific gravity: 5.6, manufactured by Mitsui Metal Corp.)
3.5 parts by weight(23.8% by volume of resin coating layer)

All of the above-identified ingredients except for the ferrite particles were dispersed by a sand mill for one hour to prepare a solution for forming a coating layer. The solution and ferrite particles were placed in a kneader equipped with a vacuum deaerator. The contents were stirred for 20 minutes at60° C. under a reduced pressure to obtain particles of Carrier L having a resin coating layer on the ferrite. The resin coating layer was 0.8 μm thick.

The solution was coated onto an electroconductive ITO glass base by an applicator to obtain a resin coating film 10 μm thick.

Respective magnetic brushes were formed only of the ferrite or Carrier L, and the electrical resistances of the ferrite or Carrier L forming the respective magnetic brushes were measured. The electrical resistances, to which under the electric field of $10^4$ V/cm actural resistances were extrapolated, of the ferrite and Carrier L were $1\times10^{-5}$ Ω·cm and $2\times10^6$ Ω·cm respectively. The electrical resistance of the resin coating layer was $6\times10^4$ Ω·cm under an electric field of 100 V/cm.

Carrier M

Iron powder (TSV; average particle diameter: 60 μm, manufactured by Powdertech Co., Ltd.)
100 parts by weight Toluene
8 parts by weight Styrene/methyl methacrylate copolymer (monomer ratio: 20:80; Mw: 73,000)
1 part by weight Carbon black (VXC 72; electrical resistance: $10^{-1}$ Ω·cm, specific gravity: 1.8, manufactured by Cabot Co.)
0.2 parts by weight (10% by volume of resin coating layer)

All of the above-identified ingredients except for the iron powder were dispersed by a sand mill for one hour to prepare a solution for forming a coating layer. The solution and iron powder were placed in a kneader equipped with a vacuum deaerator. The contents were stirred for 20 minutes at 60° C. under a reduced pressure to obtain particles of Carrier M having a resin coating layer on the iron powder. The resin coating layer was 0.8 μm thick.

The solution was coated onto an electroconductive ITO glass base by an applicator to obtain a resin coating film 10 μm thick.

Respective magnetic brushes were formed only of the iron powder or Carrier M, and the electrical resistances of the iron powder or Carrier M forming the respective magnetic brushes were measured. The electrical resistances, to which under the electric field of $10^4$ V/cm actural resistances were extrapolated, of the iron powder and Carrier M were $1\times10^{-14}$ Ω·cm and $2\times10^3$ Ω·cm respectively. The electrical resistance of the resin coating layer was $3\times10^2$ Ω·cm under an electric field of 100 V/cm.

For comparison, the following carriers were prepared:

Carrier N

Magnetite (MX030A; average particle diameter: 50 μm, manufactured by Fuji Electrochemical Co., Ltd.)
100 parts by weight Toluene
14.5 parts by weight Styrene/methyl methacrylate copolymer (monomer ratio: 20:80; Mw: 73,000)
2 parts by weight Carbon black (VXC 72; electrical resistance: $10^{-1}$ Ω·cm; specific gravity: 1.8, manufactured by Cabot Co.)
0.08 parts by weight (2.2% by volume of resin coating layer)

The resin solution, which was prepared by dissolving the resin in toluene, and magnetite were placed in a kneader equipped with a vacuum deaerator. The contents were stirred for 20 minutes at 60° C. under a reduced pressure to obtain particles of Carrier N having a resin coating layer on the magnetite. The resin coating layer was 0.8 μm thick. Carrier N was observed under an SEM and the result showed that the magnetite was coated uniformly with the resin without exposed surface.

The solution was coated onto an electroconductive ITO glass base by an applicator to obtain a resin coating film 10 μm thick.

Magnetic brushes were formed only of the Carrier N, and the electrical resistance of Carrier N forming the magnetic brushe was measured. The electrical resistance, to which under the electric field of $10^4$ V/cm actural resistance was extrapolated, of Carrier N were $5.2\times10^9$ Ω·cm. The electrical resistance of the resin coating layer was $3.6\times10^9$ Ω·cm under an electric field of 100 V/cm.

Carrier O

Magnetite (MX030A; average particle diameter: 50 μm, manufactured by Fuji Electrochemical Co., Ltd.)
100 parts by weight Toluene
4.5 parts by weight Styrene/methyl methacrylate copolymer (monomer ratio: 20:80; Mw: 73,000)
2 parts by weight Carbon black (VXC 72; electrical resistance: $10^{-1}$ Ω·cm, specific gravity: 1.8, manufactured by Cabot Co.)
0.6 parts by weight (14.3% by volume of resin coating layer)

All of the above-identified ingredients except for the magnetite were dispersed by a sand mill for one hour to prepare a solution for forming a coating layer. The solution and magnetite particles were placed in a kneader equipped with a vacuum deaerator. The contents were stirred for 20 minutes at 60° C. under a reduced pressure to obtain particles of Carrier O having a resin coating layer on the magnetite. The resin coating layer was 0.8 μm thick.

The solution was coated onto an electroconductive ITO glass base by an applicator to obtain a resin coating film 10 μm thick.

Magnetic brushes were formed only of the Carrier O, and the electrical resistance of Carrier O forming the magnetic brushe was measured. The electrical resistance, to which under the electric field of $10^4$ V/cm actural resistance was extrapolated, of Carrier O were $4.2\times10^0$ Ω·cm. The electrical resistance of the resin coating layer was $3\times10^0$ Ω·cm under an electric field of 100 V/cm.

Carrier P

Ferrite (EFC-50B; average particle diameter: 50 μm, manufactured by Powdertech Co., Ltd.)
100 parts by weight Toluene
12.6 parts by weight Styrene/methyl methacrylate copolymer (monomer ratio: 20:80; Mw: 73,000)
1.7 parts by weight Carbon black (VXC 72; electrical resistance: $10^{-1}$ Ω·cm, specific gravity: 1.8, manufactured by Cabot Co.)
0.5 parts by weight (14% by volume of resin coating layer)

All of the above-identified ingredients except for the ferrite were dispersed by a sand mill for one hour to prepare a solution for forming a coating layer. The solution and ferrite particles were placed in a kneader equipped with a vacuum deaerator. The contents were stirred for 20 minutes at 60° C. under a reduced pressure to obtain particles of Carrier P having a resin coating layer on the ferrite. The resin coating layer was 0.8 μm thick. Carrier P was observed under an SEM and the result showed that the ferrite was coated uniformly with the resin without exposed surface. The solution was coated onto an electroconductive ITO glass base by an applicator to obtain a resin coating film 10 μm thick.

Respective magnetic brushes were formed only of the ferrite or Carrier P, and the electrical resistances of the ferrite or Carrier P forming the respective magnetic brushes were measured. The electrical resistances, to which under the electric field of $10^4$ V/cm actural resistances were extrapolated, of the ferrite and Carrier P were $3.1\times10^1$ Ω·cm and $7\times10^5$ Ω·cm respectively. The electrical resistance of the resin coating layer was $8\times10^3$ Ω·cm under an electric field of 100 V/cm.

Figure 12:
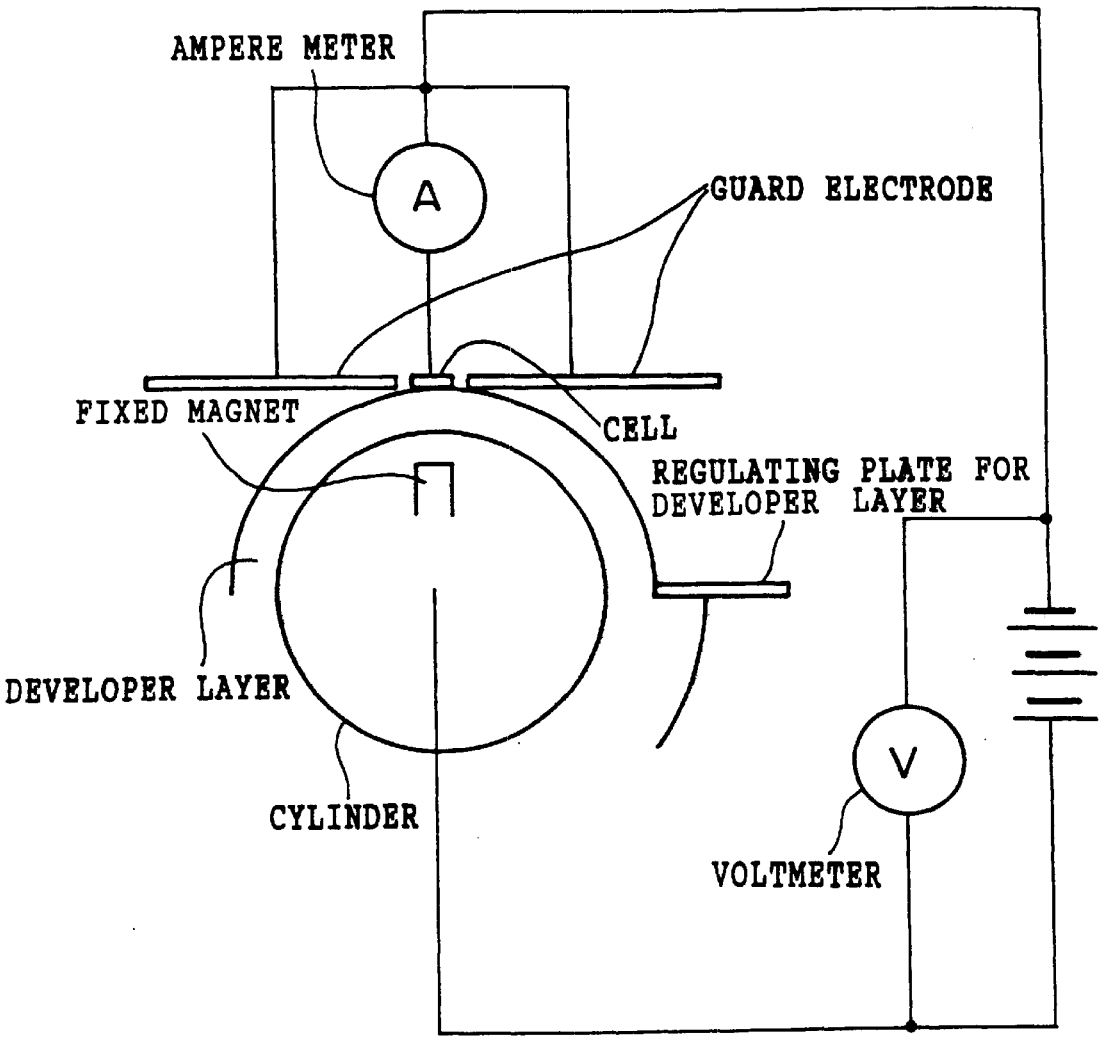
FIG. 12 is a schematic diagram illustrating an apparatus for measuring electrical resistance.

The electrical resistance of the carriers of Examples and Comparative Examples was measured as follows: As illustrated in FIG. 12, a cell was arranged to face a cylinder, which could rotate and had a fixed magnet inside thereof, so that a gap is created between the cell and the cylinder. A voltage was applied to produce an electric field of $10^4$ V/cm between the cell and the cylinder to measure the electrical current. The resistance was calculated from the measured current and the volume of the developer on the cylinder facing the cell. In this case, the cell size was such that the length in the axial direction was 60 mm and the length in the direction of the periphery of the cylinder was 5 mm. The gap between the cell and the cylinder was 2.2 mm, and the thickness of the layer of the developer was adjusted such that the developer did not clog the gap between the cell the cylinder when the cylinder rotated.

II. Developer preparation

Developers were prepared by blending 100 parts by weight of each of the above-described carriers except for Carrier M with 5 parts by weight of the magenta toner adapted to the use in an A-Color 635 copy machine manufactured by from Fuji Xerox Co., Ltd. For Carrier M, a developer was prepared by blending 100 parts by weight of Carrier M with 3.5 parts by weight of the magenta toner adapted to the use in an A-Color 635 copy machine manufactured by Fuji Xerox Co., Ltd. The f values of these developers are shown in Table 2.

TABLE 2

| Example | Volume average particle diameter of carrier (μm) | Volume average particle diameter of toner (μm) | Toner concentration (%) | Specific gravity of carrier | Specific gravity of toner | f |
|---|---|---|---|---|---|---|
| 7 | 50 | 7 | 5 | 5.2 | 1 | 51.2 |
| 8 | 35 | 7 | 5 | 4.9 | 1 | 33.8 |
| 9 | 50 | 7 | 5 | 5.3 | 1 | 52.2 |
| 10 | 60 | 7 | 3.5 | 8 | 1 | 66.2 |
| 11 | 50 | 7 | 5 | 5.2 | 1 | 51.2 |
| CE4 | 50 | 7 | 5 | 5.2 | 1 | 51.2 |
| CE5 | 50 | 7 | 5 | 5.2 | 1 | 51.2 |
| CE6 | 50 | 7 | 5 | 4.7 | 1 | 46.3 |

CE: Comparative example

These developers were charged into the image-forming apparatus 10, and the developers of Examples and Comparative Examples were evaluated for the saturated region, brush marks, and carrier beads carry over.

Concrete development and evaluation conditions were as follows:

Development conditions:

| | |
|---|---|
| Photoreceptor | OPC (84 in diameter) |
| Process speed | 160 mm/s |
| Initial electrostatic potential | −650 V |
| Potential at exposed part | −200 V |
| ROS | LED (400 dpi) |
| Magnetic roller | 30 in diameter |

-continued

| | |
|---|---|
| Peak magnetic flux density in radial direction | 100 mT |
| Speed of rotation | 336 mm/s |

Distance between developing part 56 and photoreceptor facing developing part 56 (DRS)

0.5 mm

Environmental conditions

22° C., 55% RH

Saturated Region

A rating of ○ was given to a sample which exhibited a saturated region in the developing curve produced by contrast potential and the amount of developer toner when bias potential for development was gradually changed. A rating of × was given to a sample which did not exhibit a saturated region in the above test.

Brush Marks

The number of white lines observed under a microscope within a width of 5 mm at a right angle to the forward direction was counted.

Carrier Beads Carry Over (CBCO)

Output images were visually inspected. A rating of ○ was given to an image entirely free of carrier beads carry over, while a rating of × was given to an image indicating carrier beads carry over.

The bias potential for development in the test of brush marks and carrier beads carry over was applied so that the amount of developer toner exhibited a saturated characteristic in a developer having a saturated region and, more concretely, a DC superimposed AC bias potential, which was composed of a DC component of −500 V and an AC component (peak-to-peak voltage) of 100 V (6 kHz), was employed.

Results are shown in Table 3.

TABLE 3

| Example | Carrier | Saturated region | Brush marks (units/5 mm) | CBCO |
|---|---|---|---|---|
| 7 | A | ○ | 0 | ○ |
| 8 | B | ○ | 0 | ○ |
| 9 | C | ○ | 0 | ○ |
| 10 | D | ○ | 0 | ○ |
| CE4 | E | X | 0 | ○ |
| CE5 | F | ○ | 10 | X |
| CE6 | G | X | 4 | X |

CE: Comparative Example

As is apparent from Table 3, if the developers of Examples 7–10 are used, a highly and completely saturated region is obtained, and no brush marks or carrier beads carry over is observed. On the other hand, in the developer of Comparative Example 4, which is made up of a low-resistance core uniformly coated with a high-resistance resin, no saturated region is observed, although no brush marks or carrier beads carry over is observed. This is presumably because the excessively high electrical resistance of the coating resin layer brings about the property of the electrically insulated carrier.

In the developer of Comparative Example 5, which is made up of a low-resistance core uniformly coated with a low-resistance resin, the electrical resistance of the carrier becomes $10^1$ Ω·cm or less to cause brush marks and carrier beads carry over along with a low image density, although a saturated region is obtained.

Meanwhile, in the developer of Comparative Example 6, which is made up of a intermediate-resistance core, no saturated region is observed despite the relatively low electrical resistance of the core. In this case, brush marks and carrier beads carry over are observed. Presumably this is because the electrical resistance of the carrier itself is excessively high.

EXAMPLE 11

I. Carrier Preparation

Carrier Q

Magnetite (MX030A; average particle diameter: 50 μm, manufactured by Fuji Electrochemical Co., Ltd.)
100 parts by weight Toluene
14 parts by weight Styrene/methyl methacrylate copolymer(monomer ratio: 20:80; Mw: 73,000)
2 parts by weight Tin oxide-coated barium sulfate (Passtran Type-IV, electrical resistance: $4.6\times10^4$ Ω·cm; specific gravity: 4.6, manufactured by Mitsui Metal Corp.)
6.1 part by weight (40% by volume of resin coating layer)

All of the above-identified ingredients except for the magnetite particles were dispersed by a sand mill for one hour to prepare a solution for forming a coating layer. The solution and ferrite particles were placed in a kneader equipped with a vacuum deaerator. The contents were stirred for 20 minutes at 60° C. under a reduced pressure to obtain particles of Carrier Q having a resin coating layer on the magnetite. The resin coating layer was 0.8 μm thick.

The solution was coated onto an electroconductive ITO glass base by an applicator to obtain a resin coating film 10 μm thick.

Magnetic brushes were formed only of the Carrier Q, and the electrical resistance of Carrier Q forming the magnetic brushe was measured. The electrical resistance, to which under the electric field of $10^4$ V/cm actural resistance was extrapolated, of Carrier Q were $3.5\times10^6$ Ω·cm. The electrical resistance of the resin coating layer was $5\times10^5$ Ω·cm under an electric field of 100 V/cm.

II. Developer Preparation

A developer was prepared by blending 100 parts by weight of Carrier Q prepared above with 5 parts by weight of the magenta toner adapted to the use in an A-Color 635 copy machine manufactured by Fuji Xerox Co., Ltd. The f value of this developer is shown in aforesaid Table 2.

Developer Evaluation

The developer was charged into the image-forming apparatus 10, and the developer was evaluated for image quality and brush marks. Concrete conditions for development and evaluation methods were the same as those previously adopted except that the peak-to-peak voltage of the AC component for bias potential for development was changed. The frequency of the AC component was the same value as in Examples 7–10 and was 6 kHz. For comparison, the developer of Example 7 was evaluated under the same conditions. Results are shown in Table 4.

TABLE 4

| AC component | Example 11 | | Example 7 | |
|---|---|---|---|---|
| peak-to-peak voltage | Image density uniformity | Brush marks | Image density uniformity | Brush marks |
| 100 | ○ | ○ | ○ | ○ |
| 200 | ○ | ○ | ○ | ○ |
| 300 | ◎ | ○ | Δ | Δ |
| 400 | ◎ | ○ | Δ | Δ |
| 400 | ◎ | ○ | Δ | Δ |

As is apparent from Table 4, in Example 11, as the peak-to-peak voltage of the AC component increases, the uniformity of image density improves without increasing the formation of brush marks. on the other hand, in Example 7, as the peak-to-peak voltage of the AC component increases, the uniformity of image density becomes inferior and the formation of brush marks increase. Accordingly, it is possible to accomplish the two objectives, i.e., the improvement in image quality and the prevention of brush marks, by means of a carrier comprising an electroconductive powder having a high electrical resistance.

EXAMPLE 12

Comparative Example 7

Developers were prepared by blending 100 parts each by weight of Carrier J of Example 7 with 5 parts by weight of the yellow toner, magenta toner, and cyan toner, respectively, which were each adapted to the use in an A-Color 635 copy machine manufactured by Fuji Xerox Co., Ltd. These developers were charged, respectively, into the developing part 56 of the image-forming apparatus 10. As a photoreceptor 16, a photoreceptor (photoreceptor A), which had the light energy attenuation curve shown in FIG. 8A and had nonuniformity in sensitivity in the peripheral direction, was used, and a latent image (proportion of input image area: 50%) approximately corresponding to skin color was formed on the photoreceptor. Meanwhile, as a photoreceptor 16, another photoreceptor (photoreceptor B), which had the light energy attenuation curve of FIG. 8A and had nonuniformity in sensitivity in the direction of axis of rotation, was used, and a latent image (proportion of input image area: 50%) approximately corresponding to skin color was formed on the photoreceptor. For the developing operation, in order that the amount of developer toner on the latent image would exhibit a saturated characteristic, a DC-superimposed AC bias potential, which was composed of DC component of −500 V and an AC component (peak-to-peak voltage) of 100 V (6 kHz), was applied to the magnetic roller 62. In this experiment, the specific gravity and the volume average diameter of each of the yellow toner and the cyan toner were the same as those of the magenta toner.

Developers of different colors were prepared by blending 100 parts by weight of Carrier N of Comparative Example of 4 with 5 parts by weight of the yellow toner, the magenta toner, and the cyan toner, respectively, which were each adapted to the use in an A-Color 635 copy machine manufactured by Fuji Xerox Co., Ltd. The test of these developers were conducted as described above.

The contrast potential of a latent image, which was produced by the surface potential of the exposed part and the surface potential of the unexposed part when exposure was carried out so that the proportion of the input image area was 50% was 90% or more of the contrast potential of a latent image, which was produced by the electrostatic potential of the photoreceptor and the average surface potential of the exposed part of the photoreceptor when exposure was carried out so that the proportion of the input image area was 100%.

The difference in color in the image on the recording material, which corresponded to the entire image-forming region of the photoreceptor, was visually inspected. Results are shown in Table 5.

TABLE 5

| Example | | Photoreceptor (A) | Photoreceptor (B) |
|---|---|---|---|
| 12 | Saturation development (Carrier: $1.8 \times 10^8$ Ω · cm) | ○ | ○ |
| CE 7 | Nonsaturation development (Carrier: $5.2 \times 10^9$ Ω · cm) | ○ | X |

CE: Comparative example
○ Difference in color is not observed in the same image.
X Difference in color is observed in the same image.

In the developer comprising Carrier N, that is, in the developer exhibiting no saturated region, difference in color within the image due to the nonuniform sensitivity of the photoreceptor was clearly recognized. However, in the developer comprising Carrier J, that is, in the developer exhibiting the presence of saturated region, difference in color within the image due to the nonuniform sensitivity of the photoreceptor was not recognized and a stable gradation was observed in spite of the change in the potential of the latent image.

EXAMPLE 13

By use of a photoreceptor drum, which had the light energy attenuation curve in FIG. 8B, and the developer in Example 7, a test was conducted regarding the maintenance of image density and the maintenance of intermediate density. Testing conditions are shown in Table 6.

TABLE 6

| Set value of contrast (v) | Set value of bias (v) | Potential of image part (v) | Potential of background (v) |
|---|---|---|---|
| 700 | 715 | 15 | 865 |

Figure 13:
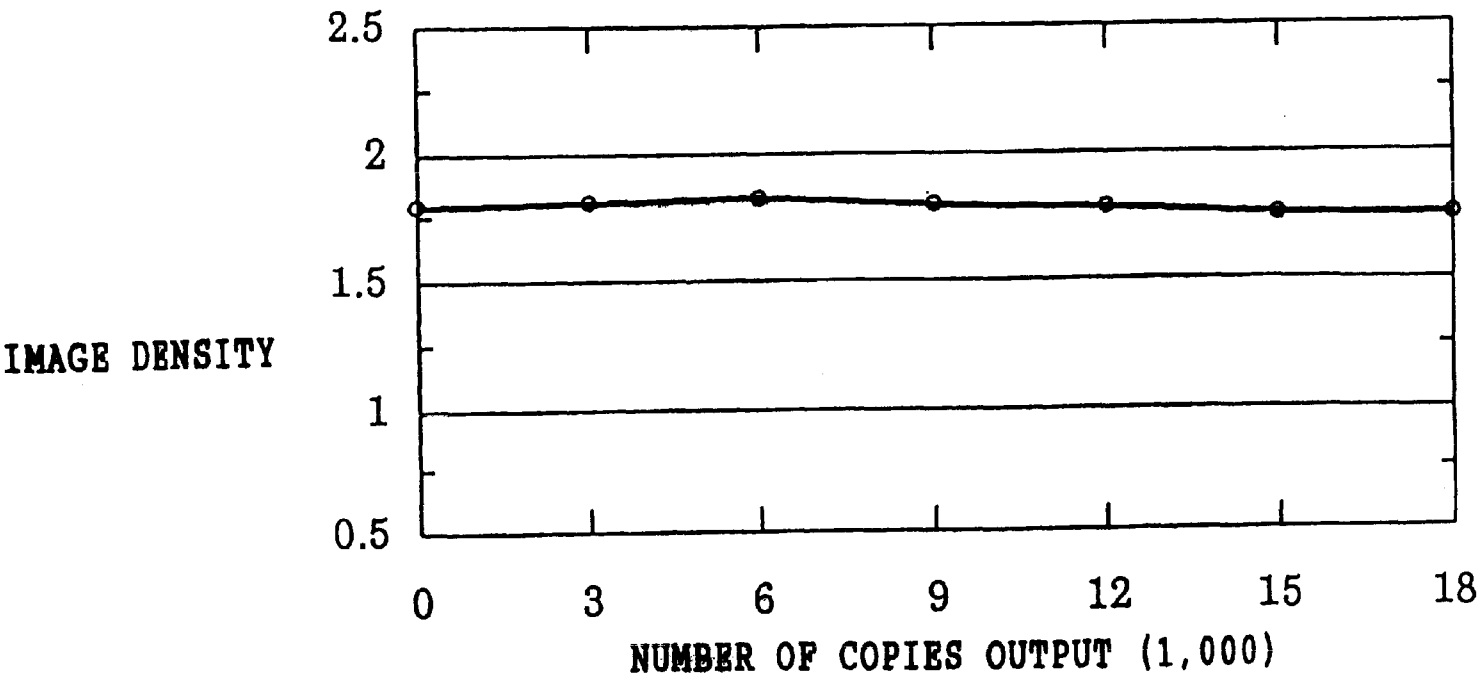
FIG. 13 is a graph indicating the density-maintaining performance for the solid area of an image in examples of the present invention.
Figure 14:
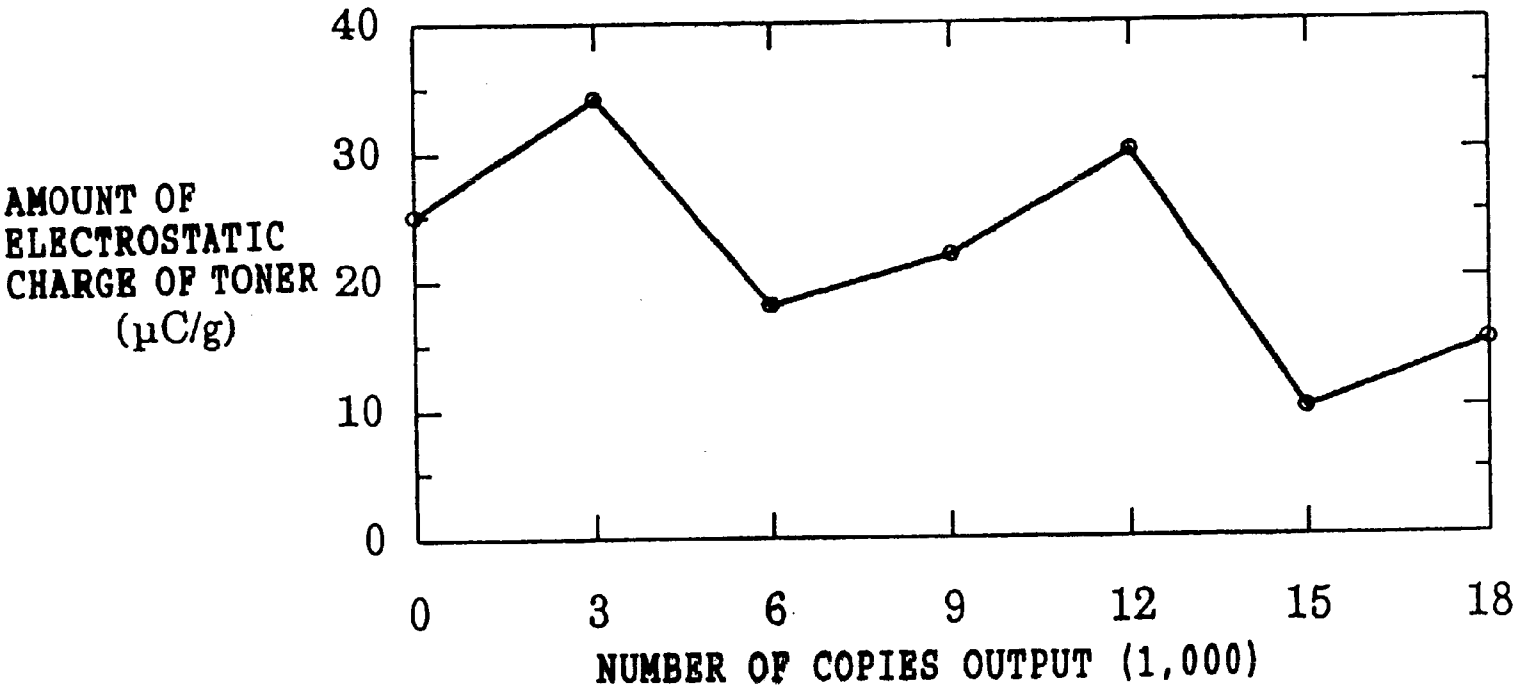
FIG. 14 is a graph indicating the toner-charge-maintaining performance which was obtained when the density-maintaining performance of FIG. 13 was tested.
Figure 15:
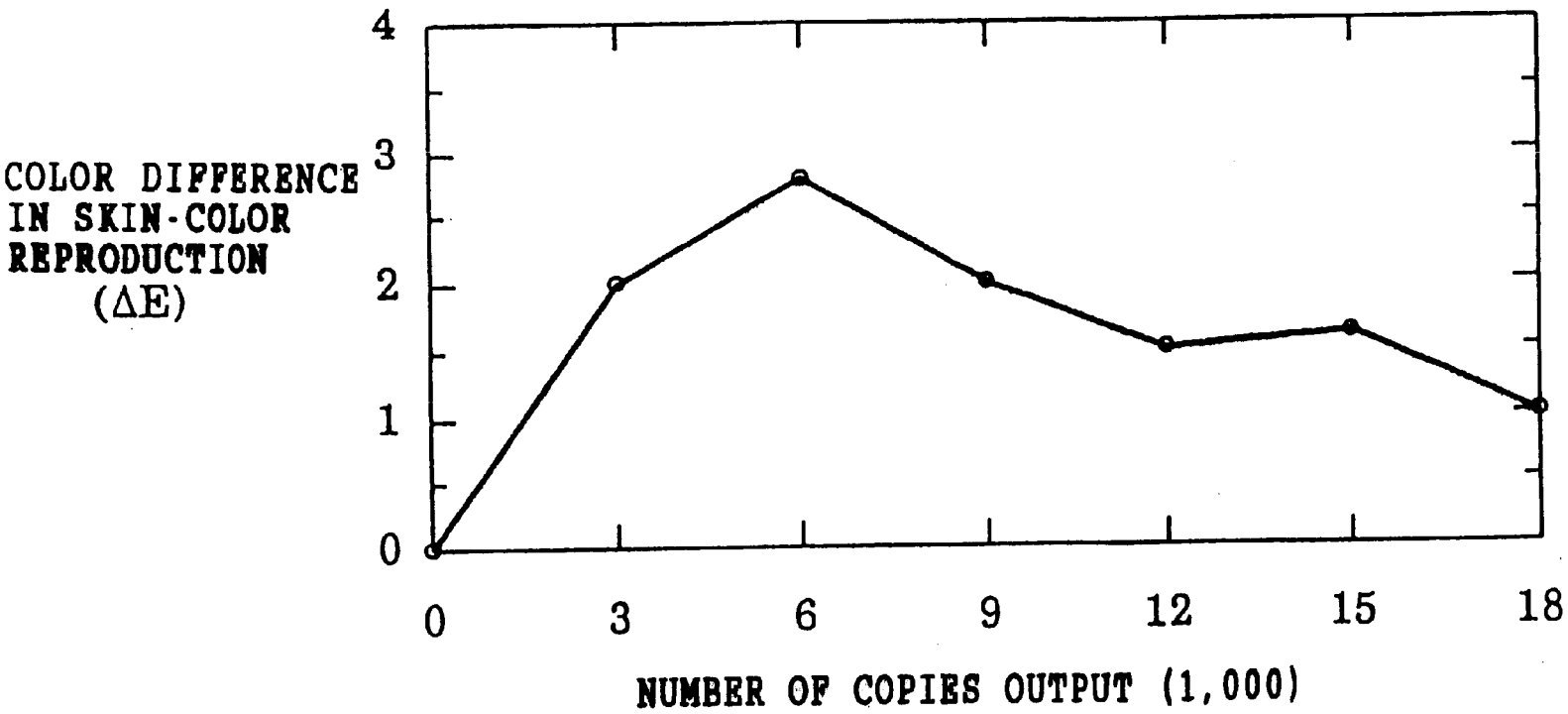
FIG. 15 is a graph indicating the medium-density-maintaining performance in examples of the present invention.

The light exposure energy of the latent image is represented by two voltages by the calculation method described in aforesaid Proceedings, IS&T's 9th International Congress on Advances in Nonimpact Printing Technologies, Vol. 9, 1993. FIG. 13 shows the density maintaining performance for the solid image part. FIG. 14 shows the charge amount of toner when the maintenance test for FIG. 13 was conducted. FIG. 15 shows the performance for intermediate density maintenance. From FIGS. 13–15, it can be seen that the image density at the solid image part is stable and that the reproduction of an intermediate color represented by skin color is also stable as indicated by the color difference of 3 or less.

EXAMPLES 14–18

Comparative Examples 8 and 9

Developers having different toner concentrations were prepared from Carrier J of Example 7 (particle diameter of magnetite: 50 μm) and the magenta toner adapted to the use in an A-Color 635 copy machine manufactured by Fuji Xerox Co., Ltd. (Examples 14–16 and Comparative Example 8). Similarly, developers having different toner concentrations were prepared from Carrier K of Example 8 (particle diameter of ferrite: 35 μm) and the magenta toner adapted to the use in an A-Color 635 copy machine manufactured by Fuji Xerox Co., Ltd. (Examples 17 and 18 Comparative Example 9). These developers were charged, respectively, into the same image-forming apparatus as in Example 7, and the evaluation was conducted for image density and saturated region. Results are shown in Tables 7 (Carrier J) and 8 (Carrier K).

TABLE 7

| Example | Toner concentration | f | Image density | Saturated region | Image defect |
|---|---|---|---|---|---|
| 14 | 2.5% | 25.6 | 1.75 | ○ | Absent |
| 15 | 5% | 51.2 | 1.82 | ○ | Absent |
| 16 | 7% | 71.7 | 1.85 | ○ | Absent |
| CE 8 | 9% | 92.2 | 1.85 | X | Absent |

CE: Comparative Example

TABLE 8

| Example | Toner concentration | f | Image density | Saturated region | Image defect |
|---|---|---|---|---|---|
| 17 | 3.5% | 23.7 | 1.50 | ○ | Absent |
| 18 | 5% | 33.8 | 1.80 | ○ | Absent |
| CE 9 | 12% | 81.1 | 1.82 | X | Absent |

CE: Comparative Example

As is apparent from these tables, even if particle diameters of the carriers are different, no saturated region can be obtained in a developer which has a toner concentration providing an f value exceeding 75. On the other hand, in the case of a developer having an f value from 20 to 75, a satisfactory image density free of image defect is obtained and a saturated region is obtained.

What is claimed is:

1. An image-forming method comprising the steps of forming a latent image on a latent image substrate, which is uniformly charged, based on image data, and developing the latent image by a developer held on a developer carrying member provided with a bias potential for development, wherein the developer comprises a magnetic carrier, which comprises a core and a resin coating layer formed thereon containing an electroconductive powder such that, when the magnetic brush is formed only of the core, the dynamic electrical resistance of the core forming the magnetic brush is 1 Ω·cm or less under an electric field of $10^4$V/cm, and when the magnetic brush is formed only of the magnetic carrier, the electrical resistance of the magnetic carrier forming the magnetic brush is from 10 to $1\times10^9$ Ω·cm under an electric field of $10^4$V/cm, and toner, wherein the developer has a saturated region in the developing curve defined by a contrast potential, which is determined by bias potential for development and the potential at the exposed part on the latent image substrate, and the amount of developer toner moving to the latent image on the latent image substrate, and wherein bias potential is applied to the developer carrying member so that the amount of developer toner exhibits the saturation characteristic and wherein the toner comprises a binder and a colorant.

2. An image-forming method according to claim 1, wherein the thickness of the resin coating layer is from 0.1 to 5 μm.

3. An image-forming method according to claim 1, wherein the electrical resistance of the resin coating layer is from 10 to $1\times10^8$ Ω·cm.

4. An image-forming method according to claim 1, wherein the core is a ferrite.

5. An image forming method according to claim 1, wherein the electrical resistance of the electroconductive powder is $1\times10^6$ Ω·cm or less.

6. An image-forming method according to claim 1, wherein bias potential for development is a DC electrical field superimposed with an AC electrical field having a peak-to-peak voltage from 100 to 500 V and a frequency from 400 Hz to 20 kHz.

7. An image-forming method according to claim 1, wherein the value of f, which is defined by the following equation, is from 20 to 75, $$f = \frac{3^{0.5} \times R \times \rho_c \times C}{2\pi \times r \times \rho_t}$$

where R is the volume average particle diameter (μm) of the magnetic carrier, r is the volume average particle diameter (μm) of the toner particles, C is the relative concentration of the toner, $\rho_c$ is the specific gravity of the carrier, and $\rho_t$ is the specific gravity of the toner.

8. An image-forming method according to claim 1, wherein the contrast potential of a latent image, which is produced by the surface potential of the exposed part and the surface potential of the unexposed part when exposure is carried out so that the proportion of the input image area is 50%, is 90% or more of the contrast potential of a latent image, which was produced by the electrostatic potential of the latent image substrate and the average surface potential of the exposed part of the latent image substrate when exposure is carried out so that the proportion of the input image area is 100%.

* * * * *